US008541154B2

(12) United States Patent
Iftime et al.

(10) Patent No.: US 8,541,154 B2
(45) **Date of Patent: *Sep. 24, 2013**

(54) TONER CONTAINING FLUORESCENT NANOPARTICLES

(75) Inventors: Gabriel Iftime, Mississauga (CA); Daryl W. Vanbesien, Burlington (CA); Maria M. Birau, Mississauga (CA); Jordan H. Wosnick, Toronto (CA); Peter M. Kazmaier, Missisauga (CA)

(73) Assignee: Xerox Corporation, Norwalk, CT (US)

( * ) Notice: Subject to any disclaimer, the term of this patent is extended or adjusted under 35 U.S.C. 154(b) by 893 days.

This patent is subject to a terminal disclaimer.

(21) Appl. No.: 12/245,820

(22) Filed: Oct. 6, 2008

(65) Prior Publication Data

US 2010/0086867 A1 Apr. 8, 2010

(51) Int. Cl.
*G03G 9/09* (2006.01)
*G03G 9/093* (2006.01)

(52) U.S. Cl.
USPC ..... 430/108.5; 430/110.2

(58) Field of Classification Search
USPC ..... 430/108.8, 137.14, 108.5, 110.2
See application file for complete search history.

(56) References Cited

U.S. PATENT DOCUMENTS

| | | | |
|---|---|---|---|
| 2,809,954 | A | 10/1957 | Kazenas |
| 2,938,873 | A | 5/1960 | Kazenas |
| 3,455,856 | A | 7/1969 | Voedisch et al. |
| 3,590,000 | A | 6/1971 | Palermiti et al. |
| 3,642,650 | A | 2/1972 | McIntosh |
| 3,847,604 | A | 11/1974 | Hagenbach et al. |
| 3,944,493 | A | 3/1976 | Jadwin et al. |
| 4,007,293 | A | 2/1977 | Mincer et al. |
| 4,079,014 | A | 3/1978 | Burness et al. |
| 4,291,111 | A | 9/1981 | Lu |
| 4,338,390 | A | 7/1982 | Lu |
| 4,394,430 | A | 7/1983 | Jadwin et al. |
| 4,560,635 | A | 12/1985 | Hoffend et al. |
| 4,714,682 | A | 12/1987 | Schwartz |
| 4,830,671 | A | 5/1989 | Frihart et al. |
| 4,889,560 | A | 12/1989 | Jaeger et al. |
| 4,889,761 | A | 12/1989 | Titterington et al. |
| 4,935,326 | A | 6/1990 | Creatura et al. |
| 4,937,166 | A | 6/1990 | Creatura et al. |
| 4,975,220 | A | 12/1990 | Streitel et al. |
| 5,073,498 | A | 12/1991 | Schwartz et al. |
| 5,093,147 | A | 3/1992 | Andrus et al. |
| 5,094,777 | A | 3/1992 | DiPietro |
| 5,194,638 | A | 3/1993 | Frihart et al. |
| 5,221,335 | A | 6/1993 | Williams et al. |
| 5,264,153 | A | 11/1993 | De Krom |
| 5,278,020 | A | 1/1994 | Grushkin et al. |
| 5,294,664 | A | 3/1994 | Morrison, Jr. et al. |
| 5,308,734 | A | 5/1994 | Sacripante et al. |
| 5,344,738 | A | 9/1994 | Kmiecik-Lawrynowicz et al. |
| 5,346,797 | A | 9/1994 | Kmiecik-Lawrynowicz et al. |
| 5,348,832 | A | 9/1994 | Sacripante et al. |
| 5,364,729 | A | 11/1994 | Kmiecik-Lawrynowicz et al. |
| 5,366,841 | A | 11/1994 | Patel et al. |
| 5,370,963 | A | 12/1994 | Patel et al. |
| 5,372,852 | A | 12/1994 | Titterington et al. |
| 5,403,693 | A | 4/1995 | Patel et al. |
| 5,405,728 | A | 4/1995 | Hopper et al. |
| 5,418,108 | A | 5/1995 | Kmiecik-Lawrynowicz et al. |
| 5,435,937 | A | 7/1995 | Bell et al. |
| 5,439,971 | A | 8/1995 | Hyche |
| 5,496,676 | A | 3/1996 | Croucher et al. |
| 5,501,935 | A | 3/1996 | Patel et al. |
| 5,527,658 | A | 6/1996 | Hopper et al. |
| 5,529,876 | A * | 6/1996 | Sasaki et al. ..... 430/137.12 |
| 5,554,480 | A | 9/1996 | Patel et al. |
| 5,585,215 | A | 12/1996 | Ong et al. |
| 5,593,807 | A | 1/1997 | Sacripante et al. |
| 5,597,856 | A | 1/1997 | Yu et al. |
| 5,621,022 | A | 4/1997 | Jaeger et al. |
| 5,650,255 | A | 7/1997 | Ng et al. |
| 5,650,256 | A | 7/1997 | Veregin et al. |
| 5,679,138 | A | 10/1997 | Bishop et al. |

(Continued)

FOREIGN PATENT DOCUMENTS

| | | | |
|---|---|---|---|
| CN | 1278847 | A | 1/2001 |
| CN | 1836012 | A | 9/2006 |

(Continued)

OTHER PUBLICATIONS

U.S. Appl. No. 12/245,824, filed Oct. 6, 2008, Maria Birau et al.
U.S. Appl. No. 12/246,175, filed Oct. 6, 2008, Gabriel Iftime et al.
U.S. Appl. No. 12/245,782, filed Oct. 6, 2008, Gabriel Iftime et al.
U.S. Appl. No. 12/246,120, filed Oct. 6, 2008, Maria Birau et al.
May 28, 2009 Office Action issued in U.S. Appl. No. 12/245,824.
Nov. 20, 2009 Office Action issued in U.S. Appl. No. 12/245,824.
Nov. 16, 2009 Search Report issued in 09171060.8.
Office Action for corresponding Canadian Patent Application No. 2,680,954, mailed on May 9, 2011.

(Continued)

*Primary Examiner* — Jonathan Jelsma
(74) *Attorney, Agent, or Firm* — Oliff & Berridge, PLC

(57) ABSTRACT

A method for making toners to include at least one nanoscale fluorescent pigment particle composition and/or a fluorescent organic nanoparticle composition. The particles are incorporated into emulsion of toner and used in making toner via emulsion aggregation. Such toners may have a core and/or a shell and the clay composites may be included within the core, the shell or both. The fluorescent organic nanoparticle composition includes a polymeric matrix obtained by modified EA latex process and/or emulsion polymerization and one or more fluorescent dyes and the nanoscale fluorescent pigment particle composition includes pigment molecules with at least one functional moiety, and a sterically bulky stabilizer compound including at least one functional group, the functional moiety of the pigment associates non-covalently with the functional group of the stabilizer, and the presence of the associated stabilizer limits the extent of particle growth and aggregation, to afford nanoscale-sized pigment particles.

12 Claims, No Drawings

(56) References Cited

U.S. PATENT DOCUMENTS

| | | | | |
|---|---|---|---|---|
| 5,723,253 | A | 3/1998 | Higashino et al. | |
| 5,728,797 | A | 3/1998 | O'Dell et al. | |
| 5,744,520 | A | 4/1998 | Kmiecik-Lawrynowicz et al. | |
| 5,747,215 | A | 5/1998 | Ong et al. | |
| 5,763,133 | A | 6/1998 | Ong et al. | |
| 5,766,818 | A | 6/1998 | Smith et al. | |
| 5,804,349 | A | 9/1998 | Ong et al. | |
| 5,827,633 | A | 10/1998 | Ong et al. | |
| 5,840,462 | A | 11/1998 | Foucher et al. | |
| 5,853,943 | A | 12/1998 | Cheng et al. | |
| 5,853,944 | A | 12/1998 | Foucher et al. | |
| 5,869,215 | A | 2/1999 | Ong et al. | |
| 5,869,216 | A | 2/1999 | Ong et al. | |
| 5,869,558 | A | 2/1999 | Hou | |
| 5,916,725 | A | 6/1999 | Patel et al. | |
| 5,928,830 | A | 7/1999 | Cheng et al. | |
| 5,945,245 | A | 8/1999 | Mychajlowskij et al. | |
| 6,103,006 | A * | 8/2000 | DiPietro | 106/493 |
| 6,120,967 | A | 9/2000 | Hopper et al. | |
| 6,130,021 | A | 10/2000 | Patel et al. | |
| 6,174,937 | B1 | 1/2001 | Banning et al. | |
| 6,268,222 | B1 | 7/2001 | Chandler et al. | |
| 6,294,306 | B1 | 9/2001 | Kmiecik-Lawrynowicz et al. | |
| 6,309,787 | B1 | 10/2001 | Cheng | |
| 6,399,713 | B1 | 6/2002 | MacQueen et al. | |
| 6,413,692 | B1 | 7/2002 | Cheng | |
| 6,447,974 | B1 | 9/2002 | Chen et al. | |
| 6,458,501 | B1 | 10/2002 | Cheng et al. | |
| 6,492,458 | B1 | 12/2002 | Pavlin | |
| 6,537,364 | B2 | 3/2003 | Dietz et al. | |
| 6,547,380 | B2 | 4/2003 | Smith et al. | |
| 6,837,918 | B2 | 1/2005 | Pozarnsky et al. | |
| 6,860,930 | B2 | 3/2005 | Wu et al. | |
| 6,867,251 | B2 | 3/2005 | Wang et al. | |
| 6,870,011 | B2 | 3/2005 | MacQueen et al. | |
| 6,902,613 | B2 | 6/2005 | Bäbler | |
| 6,906,118 | B2 | 6/2005 | Goodbrand et al. | |
| 7,037,633 | B2 | 5/2006 | Hopper et al. | |
| 7,160,380 | B2 | 1/2007 | Maeta et al. | |
| 7,270,408 | B2 | 9/2007 | Odell et al. | |
| 7,293,868 | B2 | 11/2007 | Odell et al. | |
| 7,427,323 | B1 | 9/2008 | Birau et al. | |
| 7,465,348 | B1 * | 12/2008 | Carlini et al. | 106/496 |
| 7,649,026 | B2 | 1/2010 | Allen et al. | |
| 7,834,072 | B2 | 11/2010 | Carlini et al. | |
| 7,897,653 | B2 | 3/2011 | Iftime et al. | |
| 8,236,198 | B2 * | 8/2012 | Birau et al. | 252/301.16 |
| 2002/0131941 | A1 | 9/2002 | Habeck et al. | |
| 2003/0055178 | A1 | 3/2003 | Gore et al. | |
| 2003/0199608 | A1 | 10/2003 | Kamigaki et al. | |
| 2004/0063848 | A1 | 4/2004 | Olson et al. | |
| 2004/0261657 | A1 | 12/2004 | Wu et al. | |
| 2005/0075453 | A1 | 4/2005 | Mathauer et al. | |
| 2005/0186443 | A1 | 8/2005 | Marrocco et al. | |
| 2006/0063873 | A1 | 3/2006 | Lin et al. | |
| 2006/0144290 | A1 | 7/2006 | Polk et al. | |
| 2006/0158491 | A1 | 7/2006 | Belelie et al. | |
| 2006/0158492 | A1 | 7/2006 | Odell et al. | |
| 2006/0159850 | A1 | 7/2006 | Breton et al. | |
| 2006/0240353 | A1 * | 10/2006 | Matsumura et al. | 430/109.4 |
| 2006/0293409 | A1 | 12/2006 | Sanchez et al. | |
| 2007/0012221 | A1 | 1/2007 | Maeta et al. | |
| 2007/0020542 | A1 | 1/2007 | Patel | |
| 2007/0082980 | A1 | 4/2007 | Lai et al. | |
| 2007/0120921 | A1 | 5/2007 | Carlini et al. | |
| 2007/0120924 | A1 | 5/2007 | Odell et al. | |
| 2008/0087190 | A1 | 4/2008 | Iftime et al. | |
| 2008/0090928 | A1 | 4/2008 | Iftime et al. | |
| 2008/0182193 | A1 | 7/2008 | Agur et al. | |
| 2008/0302272 | A1 | 12/2008 | Allen et al. | |
| 2008/0306189 | A1 | 12/2008 | Carlini et al. | |
| 2008/0306193 | A1 | 12/2008 | Allen et al. | |
| 2009/0155712 | A1 | 6/2009 | Sacripante et al. | |
| 2009/0214972 | A1 | 8/2009 | Wosnick et al. | |

FOREIGN PATENT DOCUMENTS

| | | | |
|---|---|---|---|
| CN | 1990613 | A | 7/2007 |
| EP | 0 463 260 | A1 | 1/1992 |
| EP | 1 736 514 | A1 | 12/2006 |
| GB | 1442835 | | 7/1976 |
| GB | 2 238 792 | A | 6/1991 |
| JP | 2002-285058 | | 10/2002 |
| JP | A-2005-238342 | | 9/2005 |
| JP | A-2007-23168 | | 2/2007 |
| JP | A-2007-23169 | | 2/2007 |
| JP | A-2007-23195 | | 2/2007 |
| WO | WO 94/11446 | | 5/1994 |
| WO | WO 2004/048482 | | 6/2004 |
| WO | WO 2006/005521 | | 1/2006 |
| WO | WO 2006/005536 | | 1/2006 |
| WO | WO 2006/011467 | | 2/2006 |
| WO | WO 2006/024103 | | 3/2006 |
| WO | WO 2006/132443 | | 12/2006 |
| WO | WO 2009/126388 | A1 | 10/2009 |

OTHER PUBLICATIONS

Jun. 9, 2011 Office Action issued in U.S. Appl. No. 12/246,175.
May 12, 2010 Office Action issued in U.S. Appl. No. 12/245,824.
Jun. 29, 2010 Advisory Action issued in U.S. Appl. No. 12/245,824.
Jun. 24, 2011 Office Action issued in U.S. Appl. No. 12/245,782.
Sep. 16, 2011 Office Action issued in U.S. Appl. No. 12/246,120.
Oct. 14, 2011 Office Action issued in U.S. Appl. No. 12/245,782.
Sep. 29, 2011 Office Action issued in U.S. Appl. No. 12/246,175.
Feb. 25, 2013 Chinese Office Action issued in Chinese Patent Application No. 200910179019.6 (with translation).
Apr. 11, 2013 Mexican Office Action issued in Mexican Patent Application No. MX/a/2009/010653 (with partial translation).
Feb. 25, 2013 Chinese Office Action issued in Chinese Patent Application No. 200910179014.3 (with translation).

* cited by examiner

TONER CONTAINING FLUORESCENT NANOPARTICLES

TECHNICAL FIELD

This disclosure is generally directed to toner compositions containing fluorescent nanoparticles. More specifically, this disclosure is directed to emulsion aggregation toners containing at least one nanoscale fluorescent pigment particle and/or at least one fluorescent organic nanoparticle, and the use of such emulsion aggregation toners in methods for forming images.

RELATED APPLICATIONS

Commonly assigned, U.S. patent application Ser. No. 11/187,007, filed Jul. 22, 2005, describes a toner comprising particles of a resin, a colorant, an optional wax, and a polyion coagulant, wherein said toner is prepared by an emulsion aggregation process.

Commonly assigned, U.S. patent application Ser. No. 10/606,298, filed Jun. 25, 2003, which has matured into U.S. Pat. No. 7,037,633, describes a toner process comprised of a first heating of a mixture of an aqueous colorant dispersion, an aqueous latex emulsion, and an aqueous wax dispersion in the presence of a coagulant to provide aggregates, adding a base followed by adding an organic sequestering agent, and thereafter accomplishing a second heating, and wherein said first heating is below the latex polymer glass transition temperature (Tg), and said second heating is above about the latex polymer Tg.

Commonly assigned, U.S. patent application Ser. No. 11/626,977, filed Jan. 25, 2007, describes a polyester resin emulsion comprising crosslinked polyester resin in an emulsion medium, the crosslinked polyester resin having a degree of crosslinking of from about 0.1 percent to about 100 percent.

Commonly assigned, U.S. patent application Ser. No. 11/548,774, filed Oct. 12, 2006, describes an ink set comprised of at least one radiation curable fluorescent ink comprising at least one curable monomer or oligomer, optionally at least one photoinitiator, and at least one fluorescent material, wherein upon exposure to activating energy, the fluorescent material fluoresces to cause a visible change in the appearance of the ink.

Commonly assigned, U.S. patent application Ser. No. 11/548,775, filed Oct. 12, 2006, describes an ink set comprised of at least one fluorescent phase change ink comprising at least one fluorescent material, wherein upon exposure to activating energy, the fluorescent material fluoresces to cause a visible change in the appearance of the ink.

The appropriate components, for example, waxes, coagulants, resin latexes, surfactants, and colorants, and processes of the above copending applications and patents may be selected for the present disclosure in embodiments thereof. The entire disclosures of the above-mentioned applications are totally incorporated herein by reference.

Disclosed in commonly assigned U.S. patent application Ser. No. 11/759,906 filed Jun. 7, 2007, is a nanoscale pigment particle composition, comprising: a quinacridone pigment including at least one functional moiety, and a sterically bulky stabilizer compound including at least one functional group, wherein the functional moiety associates non-covalently with the functional group; and the presence of the associated stabilizer limits the extent of particle growth and aggregation, to afford nanoscale-sized particles. Also disclosed is a process for preparing nanoscale quinacridone pigment particles, comprising: preparing a first solution comprising: (a) a crude quinacridone pigment including at least one functional moiety and (b) a liquid medium; preparing a second solution comprising: (a) a sterically bulky stabilizer compound having one or more functional groups that associate non-covalently with the functional moiety, and (b) a liquid medium; combining the first solution into the second solution to form a third solution and effecting a reconstitution process which forms a quinacridone pigment composition wherein the functional moiety of the pigment associates non-covalently with the functional group of the stabilizer and having nanoscale particle size. Still further is disclosed a process for preparing nanoscale quinacridone pigment particles, comprising: preparing a first solution comprising a quinacridone pigment including at least one functional moiety in an acid; preparing a second solution comprising an organic medium and a sterically bulky stabilizer compound having one or more functional groups that associate non-covalently with the functional moiety of the pigment; treating the second solution containing with the first solution; and precipitating quinacridone pigment particles from the first solution, wherein the functional moiety associates non-covalently with the functional group and the quinacridone pigment particles have a nanoscale particle size.

Disclosed in commonly assigned U.S. patent application Ser. No. 11/759,913 filed Jun. 7, 2007, is a nanoscale pigment particle composition, comprising: an organic monoazo laked pigment including at least one functional moiety, and a sterically bulky stabilizer compound including at least one functional group, wherein the functional moiety associates non-covalently with the functional group; and the presence of the associated stabilizer limits the extent of particle growth and aggregation, to afford nanoscale-sized pigment particles. Also disclosed is a process for preparing nanoscale-sized monoazo laked pigment particles, comprising: preparing a first reaction mixture comprising: (a) a diazonium salt including at least one functional moiety as a first precursor to the laked pigment and (b) a liquid medium containing diazotizing agents generated in situ from nitrous acid derivatives; and preparing a second reaction mixture comprising: (a) a coupling agent including at least one functional moiety as a second precursor to the laked pigment and (b) a sterically bulky stabilizer compound having one or more functional groups that associate non-covalently with the coupling agent; and (c) a liquid medium combining the first reaction mixture into the second reaction mixture to form a third solution and effecting a direct coupling reaction which forms a monoazo laked pigment composition wherein the functional moiety associates non-covalently with the functional group and having nanoscale particle size. Further disclosed is a process for preparing nanoscale monoazo laked pigment particles, comprising: providing a monoazo precursor dye to the monoazo laked pigment that includes at least one functional moiety; subjecting the monoazo precursor dye to an ion exchange reaction with a cation salt in the presence of a sterically bulky stabilizer compound having one or more functional groups; and precipitating the monoazo laked pigment as nanoscale particles, wherein the functional moiety of the pigment associates non-covalently with the functional group of the stabilizer and having nanoscale particle size.

Commonly assigned, U.S. patent application Ser. No. 11/187,007, filed Jul. 22, 2005, describes a toner comprising particles of a resin, a colorant, an optional wax, and a polyion coagulant, wherein said toner is prepared by an emulsion aggregation process.

Commonly assigned, U.S. patent application Ser. No. 10/606,298, filed Jun. 25, 2003, which has matured into U.S.

Pat. No. 7,037,633, describes a toner process comprised of a first heating of a mixture of an aqueous colorant dispersion, an aqueous latex emulsion, and an aqueous wax dispersion in the presence of a coagulant to provide aggregates, adding a base followed by adding an organic sequestering agent, and thereafter accomplishing a second heating, and wherein said first heating is below the latex polymer glass transition temperature (Tg), and said second heating is above about the latex polymer Tg.

Commonly assigned, U.S. patent application Ser. No. 11/626,977, filed Jan. 25, 2007, describes a polyester resin emulsion comprising crosslinked polyester resin in an emulsion medium, the crosslinked polyester resin having a degree of crosslinking of from about 0.1% to about 100%.

The appropriate components, for example, waxes, coagulants, resin latexes, surfactants, and colorants, and processes of the above copending applications and patents may be selected for the present disclosure in embodiments thereof. The entire disclosures of the above-mentioned applications are totally incorporated herein by reference.

REFERENCES

U.S. Pat. No. 6,447,974 describes in the Abstract a process for the preparation of a latex polymer by (i) preparing or providing a water aqueous phase containing an anionic surfactant in an optional amount of less than or equal to about 20 percent by weight of the total amount of anionic surfactant used in forming the latex polymer; (ii) preparing or providing a monomer emulsion in water which emulsion contains an anionic surfactant; (iii) adding about 50 percent or less of said monomer emulsion to said aqueous phase to thereby initiate seed polymerization and to form a seed polymer, said aqueous phase containing a free radical initiator; and (iv) adding the remaining percent of said monomer emulsion to the composition of (iii) and heating to complete an emulsion polymerization thus forming a latex polymer.

U.S. Pat. No. 6,413,692 describes in the Abstract a process comprising coalescing a plurality of latex encapsulated colorants and wherein each of said encapsulated colorants are generated by miniemulsion polymerization.

U.S. Pat. No. 6,309,787 describes in the Abstract a process comprising aggregating a colorant encapsulated polymer particle containing a colorant with colorant particles and wherein said colorant encapsulated latex is generated by a miniemulsion polymerization.

U.S. Pat. No. 6,294,306 describes in the Abstract toners which include one or more copolymers combined with colorant particles or primary toner particles and a process for preparing a toner comprising (i) polymerizing an aqueous latex emulsion comprising one or more monomers, an optional nonionic surfactant, an optional anionic surfactant, an optional free radical initiator, an optional chain transfer agent, and one or more copolymers to form emulsion resin particles having the one or more copolymers dispersed therein; (ii) combining the emulsion resin particle with colorant to form statically bound aggregated composite particles; (iii) heating the statically bound aggregated composite particles to form toner; and (iv) optionally isolating the toner.

U.S. Pat. No. 6,130,021 describes in the Abstract a process involving the mixing of a latex emulsion containing resin and a surfactant with a colorant dispersion containing a nonionic surfactant, and a polymeric additive and adjusting the resulting mixture pH to less than about 4 by the addition of an acid and thereafter heating at a temperature below about, or equal to about, the glass transition temperature (Tg) of the latex resin, subsequently heating at a temperature above about, or about equal to, the Tg of the latex resin, cooling to about room temperature, and isolating the toner product.

U.S. Pat. No. 5,928,830 describes in the Abstract a process for the preparation of a latex comprising a core polymer and a shell thereover and wherein the core polymer is generated by (A) (i) emulsification and heating of the polymerization reagents of monomer, chain transfer agent, water, surfactant, and initiator; (ii) generating a seed latex by the aqueous emulsion polymerization of a mixture comprised of part of the (i) monomer emulsion, from about 0.5 to about 50 percent by weight, and a free radical initiator, and which polymerization is accomplished by heating, and, wherein the reaction of the free radical initiator and monomer produces a seed latex containing a polymer; (iii) heating and adding to the formed seed particles of (ii) the remaining monomer emulsion of (I), from about 50 to about 99.5 percent by weight of monomer emulsion of (i) and free radical initiator; (iv) whereby there is provided said core polymer; and (B) forming a shell thereover said core generated polymer and which shell is generated by emulsion polymerization of a second monomer in the presence of the core polymer, which emulsion polymerization is accomplished by (i) emulsification and heating of the polymerization reagents of monomer, chain transfer agent, surfactant, and an initiator; (ii) adding a free radical initiator and heating; (iii) whereby there is provided said shell polymer.

U.S. Pat. No. 5,869,558 describes in the Abstract dielectric black particles for use in electrophoretic image displays, electrostatic toner or the like, and the corresponding method of manufacturing the same. The black particles are latex particles formed by a polymerization technique, wherein the latex particles are stained to a high degree of blackness with a metal oxide.

U.S. Pat. No. 5,869,216 describes in the Abstract a process for the preparation of toner comprising blending an aqueous colorant dispersion and a latex emulsion containing resin; heating the resulting mixture at a temperature below about the glass transition temperature (Tg) of the latex resin to form toner sized aggregates; heating said resulting aggregates at a temperature above about the Tg of the latex resin to effect fusion or coalescence of the aggregates; redispersing said toner in water at a pH of above about 7; contacting the resulting mixture with a metal halide or salt, and then with a mixture of an alkaline base and a salicylic acid, a catechol, or mixtures thereof at a temperature of from about 25 degrees C. to about 80 degrees C.; and optionally isolating the toner product, washing, and drying. Additional patents of interest include U.S. Pat. Nos. 5,766,818; 5,344,738; and 4,291,111.

The disclosures of each of the foregoing U.S. patents are hereby incorporated by reference herein in their entireties. The appropriate components and process aspects of the each of the foregoing U.S. patents may also be selected for the present compositions and processes in embodiments thereof.

Suitable polymer matrices for commercially available fluorescent particles include polymers made from polycondensation of p-toluene-sulfonamide with melamine formaldehyde resins as described in U.S. Pat. Nos. 2,938,873; 2,809,954; and 5,728,797.

Polyamides matrices are described resulting from condensation of a diamine with a diacid (U.S. Pat. No. 5,094,777) or from polycarboxilic acid with aminoalcohols (U.S. Pat. No. 4,975,220), polyesters (U.S. Pat. No. 5,264,153) or copolymers of ethylene carbon monoxide (U.S. Pat. No. 5,439,971) are described.

Hu et. al. describe nanocolorants (dye dissolved in crosslinked polymer nanoparticles) fabricated by a miniemulsion polymerization process of a monomer in presence of a crosslinking agent. (Z. Hu, et. al., Dyes and Pigments 76 (2008) 173-178).

A number of fluorescent particles of a size less than 200 nm are made by the so-called staining method in order to avoid surface functionalization to provide particles that are robust against thermal or chemical degradation. U.S. Pat. No. 4,714,682 describes a method of calibrating a flow cytometer or fluorescent microscope based on a set of highly uniform microbeads (with diameter of less than 5 microns) associated with a fluorescent dye; EP 1736514 describes fluorescent nanoparticles having a diameter between about 30 nm and about 100 nm.

U.S. Pat. No. 5,073,498 describes a staining process in which swelling is performed on polymer microparticles made of polystyrene in the presence of a fluorescent dye; this process provides particles containing fluorescent dye essentially on the surface, not uniformly distributed within the particles.

U.S. Pat. No. 6,268,222 describes large microparticles (several microns) having surface fluorescent nanoparticles made by a staining method. With respect to the nanoparticles component, dye present only on the surface does not provide stability against thermal, light or chemical agents.

Active Motif Chromeon (Germany) and Sigma-Aldrich (Fluka) produce water dispersible fluorescent nanoparticles (less than 100 μm) usable for biological assays.

U.S. Pat. Nos. 3,455,856 and 3,642,650 describe methods of producing liquid-based inks having fluorescent particles less than 1 μm. The particles are dispersible in water, but not in organic solvents. No particle functionalization process is described and the particles (alkyd resins copolymerized with melamine formaldehyde) are not dispersible in organic solvents.

U.S. Pat. No. 5,294,664 describes water dispersible particles "not greater than 1 micron" obtained by emulsion polymerization of polystyrene incorporating fluorescent dye. The particles are not robust and are not dispersible in organic solvents.

BACKGROUND

Emulsion aggregation toners are excellent toners to use in forming print and/or xerographic images in that the toners may be made to have uniform sizes and in that the toners are environmentally friendly. U.S. patents describing emulsion aggregation toners include, for example, U.S. Pat. Nos. 5,370,963, 5,418,108, 5,290,654, 5,278,020, 5,308,734, 5,344,738, 5,403,693, 5,364,729, 5,346,797, 5,348,832, 5,405,728, 5,366,841, 5,496,676, 5,527,658, 5,585,215, 5,650,255, 5,650,256, 5,501,935, 5,723,253, 5,744,520, 5,763,133, 5,766,818, 5,747,215, 5,827,633, 5,853,944, 5,804,349, 5,840,462, and 5,869,215.

Two main types of emulsion aggregation toners are known. First is an emulsion aggregation process that forms acrylate based, e.g., styrene acrylate, toner particles. See, for example, U.S. Pat. No. 6,120,967, incorporated herein by reference in its entirety, as one example of such a process. Second is an emulsion aggregation process that forms polyester, e.g., sodio sulfonated polyester toner particles. See, for example, U.S. Pat. No. 5,916,725, incorporated herein by reference in its entirety, as one example of such a process.

Emulsion aggregation techniques typically involve the formation of an emulsion latex of the resin particles, which particles have a small size of from, for example, about 5 to about 500 nanometers in diameter, by heating the resin, optionally with solvent if needed, in water, or by making a latex in water using an emulsion polymerization. A colorant dispersion, for example of a pigment dispersed in water, optionally also with additional resin, is separately formed. The colorant dispersion is added to the emulsion latex mixture, and an aggregating agent or complexing agent is then added to form aggregated toner particles. The aggregated toner particles are heated to enable coalescence/fusing, thereby achieving aggregated, fused toner particles.

Fluorescent toners are among the most widely used security printing features. A printed document is usually authenticated by detecting the light emitted by the fluorescent component when subjected to black light. The light emitting property cannot be reproduced in a second generation copy.

Fluorescent dyes used in fluorescent inks and toners may lose fluorescence in the print-head when the ink is heated to a temperature greater than 120° C. to melt during normal operation. To overcome this problem, the security printing industry uses hard, robust pigments containing the dye of interest. Pigments are preferred over fluorescent dyes because of their improved chemical, light fastening and thermal stability. Pigments are also preferred by the industry because there is limited or no migration or bleeding of the dye compound.

Most commercially available fluorescent pigments are made by grinding a bulk polymer matrix containing fluorescent materials. This process does not result in fluorescent particles of a size smaller than 1-2 microns, and typically the size of these particles is about 4-5 microns. According to this process, fluorescent dyes are incorporated into hard, crosslinked particles, thereby limiting the mobility of the fluorescent dye. Once the fluorescent dye is isolated from interaction with other materials present in the ink and, chemical degradation by the environment is diminished. These hard particles are dispersed in the marking material, typically liquid inks.

Inks based on fluorescent pigments are currently used in rotogravure, flexographic, silk-screening and off-set printing systems. However, given their large size, inks based on these pigments cannot be used with inkjet, solid ink or UV curable inks, because they physically clog the ink jet nozzles. In addition, they are unsuitable for fabrication of EA toners since the size of the fluorescent particles is about the size of the toner particles.

Thus, there is a need for fluorescent compositions, including fluorescent compositions that may be used in/with inkjet inks, solid inks, UV curable inks and EA (Emulsion Aggregation) toners and that have suitable thermal degradation properties. There is a further need for fluorescent compositions of such small size that may be used in/with inkjet inks, solid inks, UV curable inks and EA toners and that are compatible with organic based marking materials.

The present disclosure addresses these needs by providing emulsion aggregation toners containing at least one nanoscale fluorescent pigment particle and/or at least one fluorescent organic nanoparticle, and the use of such emulsion aggregation toners in methods for forming images.

SUMMARY

Embodiments comprise toners, and in particular toners including fluorescent nanoparticles, to provide the desired print quality.

The present disclosure provides a method for preparing toner particles, the method comprising:

(i) emulsification of an unsaturated amorphous, and/or crystalline polyester resin;

(ii) adding thereto a colorant dispersion, optionally a wax dispersion and surfactant;

(iii) adding thereto a coagulant such as an acid, metal halide or metal sulfate with homogenization of from about 2,000 to about 10,000 rpm, and optionally adjusting the pH of mixture from about 7 to about 2.5, and thereby generating aggregated composites of from about 1 to about 4 microns in diameter;

adding fluorescent nanoparticle composition, wherein the fluorescent nanoparticle composition comprises a nanoscale fluorescent pigment particle (iv) heating the aggregate mixture to a temperature of from about 30 to about 50 degrees centigrade to generate a aggregate composite with a particle size of from about 3 to about 11 microns in diameter;

(v) adjusting the pH to about 6 to about 9 to freeze the toner composite particle size and optionally adding a metal sequestering agent such as ethylenediamine tetraacetic acid sodium salt;

(vi) heating the aggregate composite to a temperature of from about 63 to about 90 degrees centigrade, and optionally adjusting the pH to about 8 to about 5.5 to result in coalesced toner particles; and (vii) washing, and drying the toner particles The present disclosure also provides a toner composition comprising:

an unsaturated polymeric resin;

an optional colorant;

an optional wax;

an optional coagulant; and a fluorescent nanoparticle composition, wherein the fluorescent nanoparticle composition comprises a nanoscale fluorescent pigment particle

EMBODIMENTS

In embodiments, a toner composition comprises toner particles comprised of at least a latex emulsion polymer resin and fluorescent nanoparticles.

Embodiments are generally directed to toner compositions comprising toner particles comprised of at least a latex emulsion polymer resin, fluorescent nanoparticles. Further embodiments are directed to emulsion/aggregation processes for the preparation of toner compositions.

Specifically, embodiments relate to the emulsion/aggregation/coalescence processes for making toner particles including fluorescent nanoparticles. In such a process, for example, resin is prepared as a water-based dispersion of generally sub-micron sized polymeric particles (polymeric latex), which are then aggregated with fluorescent nanoparticles and/or other additives, which also may be in the form of sub-micron particles, to the desired size and are then coalesced to produce toner particles. Toner compositions according to embodiments comprise a solid film-forming resin, fluorescent nanoparticles and optionally also containing one or more additives, such as gel latex, magnetites, flocculants, colorants, curing agents, waxes, charge additives, flow-promoting agents, flow-control agents, plasticizers, stabilizers, anti-gassing agents, antioxidants, UV absorbing agents, light stabilizers, fillers and the like.

In a first embodiment, nanoscale fluorescent pigment particles utilized in the present disclosure are a fluorescent nanoparticle composition, wherein the fluorescent nanoparticle composition comprises a nanoscale fluorescent pigment particle having a pigment with at least one functional moiety, and at least one sterically bulky stabilizer compound each having at least one functional group, wherein the functional moiety on the pigment associates non-covalently with the functional group of the stabilizer.

Specific materials for this embodiment include nanoscale benzothioxanthene pigment particles, and methods for producing such nanoscale benzothioxanthene pigment particles.

Benzothioxanthene pigment particles, when properly synthesized using exemplary conditions and stabilizers outlined here in the embodiments, will have a more regular distribution of nanoscale particle sizes and particle aspect ratio (length:width), the latter being about less than 5:1 to about 1:1 with the average particle length of less than about 500 nm, such as less than about 150 nm, or less than about 100 nm as measured in TEM images; and the average particle width of less than about 100 nm, such as less than about 30 nm, or less than about 20 nm, as measured in TEM images.

An advantage of the processes and compositions of the disclosure is that they provide the ability to tune particle size and composition for the intended end use application of the benzothioxanthene pigment. In embodiments, as both the particle size and particle size distribution of pigment particles decreases, the more transparent the particles become. Preferably, this leads to an overall higher color purity of the pigment particles when they are dispersed onto various media via from being coated, sprayed, jetted, extruded, etc.

A steric stabilizer may have the potential to associate itself with the pigment's and/or the pigment precursors functional moieties via, for example, hydrogen bonding, van der Waals forces, and aromatic pi-stacking such that a controlled crystallization of nanopigment particles occurs. That is, the steric stabilizer provides a functional group that is a complementary part to the functional moiety of the pigment and/or the pigment precursor. The term "complementary" as used in the phrase "complementary functional moiety of the stabilizer" indicates that the complementary functional moiety is capable of non-covalent chemical bonding such as "hydrogen bonding" with the functional moiety of the organic pigment and/or the functional moiety of the pigment precursor. The steric stabilizer loading in the reaction may vary between 5 to about 300 mol %, such as about 10 to 150% mol or about 20 to 70% mol to pigment The functional moiety of the organic pigment/pigment precursor may be any suitable moiety capable of non-covalent bonding with the complementary functional moiety of the stabilizer. For the pigment, illustrative functional moieties include, but are not limited to, the following: carbonyl groups (C═O); various sulfur containing groups, for example, sulfides, sulfones, sulfoxides, and the like; and substituted amino groups. For the pigment precursor, functional moieties include, but are not limited to, carboxylic acid groups (COOH), ester groups (COOR, where R is any hydrocarbon), anhydride groups, and amide groups.

Representative precursors include substituted naphthalene anhydrides and anilines, as indicated in Scheme 1 below. The functional moieties $R_1$, $R_2$, $R_3$, $R_4$, $R_5$, $R_6$, $R_7$, $R_8$ may be present at any position on the naphthalene and aniline aromatic ring such as ortho, meta orpara; they may be different or identical with each other and include, but are not limited to, any combination of the following functional groups: H, methyl, methoxy and carbonyl.

The pigment is prepared according to Scheme 1.

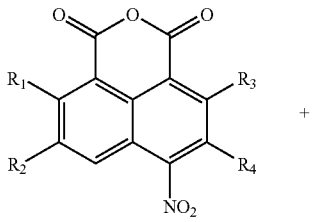

-continued

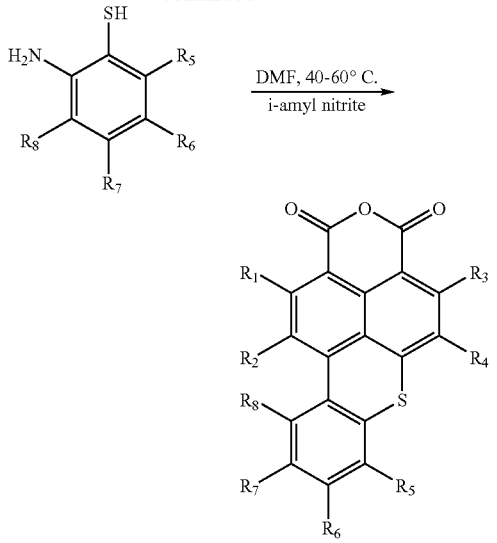

Scheme 1. Synthesis of benzo[k,l] thioxanthene-3,4-dicarboxylic anhydride

Illustrative examples of such functional moieties include: $R_1=R_2=R_3=R_4=R_5=R_6=R_7=R_8=H$, any alkyl, any aryl; $R_1=CH_3$, any alkyl, any aryl, O-aryl, O-aryl, CH═O, $R_2=R_3=R_4=R_5=R_6=R_7=R_8=H$; $R_2=CH_3$, any alkyl, any aryl, O-alkyl, O-aryl, CH═O, $R_1=R_3=R_4=R_5=R_6=R_7=R_8=H$; $R_3=CH_3$, any alkyl, any aryl, O-alkyl, O-aryl, CH═O, $R_1=R_2=R_4=R_5=R_6=R_7=R_8=H$; $R_4=CH_3$, any alkyl, any aryl, O-alkyl, O-aryl, CH═O, $R_1=R_2=R_3=R_5=R_6=R_7=R_8=H$; $R_5=CH_3$, any alkyl, any aryl, O-alkyl, O-aryl, $R_1=R_2=R_3=R_4=R_6=R_7=R_8=H$; $R_6=CH_3$, any alkyl, any aryl, O-alkyl, O-aryl, $R_1=R_2=R_3=R_4=R_5=R_7=R_8=H$; $R_7=CH_3$, any alkyl, any aryl, O-alkyl, O-aryl, $R_1=R_2=R_3=R_4=R_5=R_6=R_8=H$; $R_8=CH_3$, any alkyl, any aryl, O-alkyl, O-aryl, $R_1=R_2=R_3=R_4=R_5=R_6=R_7=H$; $R_1=R_2=CH_3$, any alkyl, any aryl, O-alkyl, O-aryl, CH═O, $R_3=R_4=R_5=R_6=R_7=R_8=H$; $R_1=R_4=CH_3$, any alkyl, any aryl, O-alkyl, O-aryl, CH═O, $R_3=R_2=R_5=R_6=R_7=R_8=H$; $R_1=R_3=CH_3$, any alkyl, any aryl, O-alkyl, O-aryl, CH═O, $R_4=R_2=R_5=R_6=R_7=R_8=H$; $R_2=R_3=CH_3$, any alkyl, any aryl, O-alkyl, O-aryl, CH═O, $R_1=R_4=R_5=R_6=R_7=R_8=H$; $R_3=R_4=CH_3$, any alkyl, any aryl, O-alkyl, O-aryl, CH═O, $R_1=R_2=R_5=R_6=R_7=R_8=H$; $R_1=R_2=R_3=CH_3$, any alkyl, any aryl, O-alkyl, O-aryl, CH═O, $R_4=R_5=R_6=R_7=R_8=H$; $R_1=R_3=R_4=CH_3$, any alkyl, any aryl, O-alkyl, O-aryl, CH═O, $R_2=R_5=R_6=R_7=R_8=H$; $R_1=R_2=R_3=R_4=CH_3$, any alkyl, any aryl, O-alkyl, O-aryl, CH═O, $R_5=R_6=R_7=R_8=H$; $R_1=R_2=R_3=R_4=CH_3$, any alkyl, any aryl, O-alkyl, O-aryl, CH═O, $R_5=CH_3$, any alkyl, any aryl, O-alkyl, O-aryl, $R_6=R_7=R_8=H$; $R_1=R_2=R_3=R_4=CH_3$, any alkyl, any aryl, O-alkyl, O-aryl, CH═O, $R_6=CH_3$, any alkyl, any aryl, O-alkyl, O-aryl, $R_5=R_7=R_8=H$; $R_1=R_2=R_3=R_4=CH_3$, any alkyl, any aryl, O-alkyl, O-aryl, CH═O; $R_7=CH_3$, any alkyl, any aryl, O-alkyl, O-aryl, $R_5=R_6=R_8=H$; and $R_1=R_2=R_3=R_4=CH_3$, any alkyl, any aryl, O-alkyl, O-aryl, CH═O, $R_8=CH_3$, any alkyl, any aryl, O-alkyl, O-aryl, $R_5=R_6=R_7=H$.

The complementary functional moiety of the stabilizer may be any suitable moiety capable of non-covalent bonding with the functional moiety of the stabilizer. Illustrative compounds containing complementary functional moieties include, but are not limited to, the following classes: beta-amino carboxylic acids and their esters containing large aromatic moieties such as phenyl, benzyl, naphthyl and the like, long linear or branched aliphatic chains such as having about 5 to about 20 carbons such as pentyl, hexyl, heptyl, octyl, nonyl, decyl, undecyl and the like; beta-hydroxy carboxylic acids and their esters containing long linear, cyclic or branched aliphatic chains such as having 5 to about 60 carbons such as pentyl, hexyl, cyclohexyl, heptyl, octyl, nonyl, decyl, undecyl and the like; sorbitol esters with long chain aliphatic carboxylic acids such as lauric acid, oleic acid, palmitic acid, stearic acid; polymeric compounds such as polyvinylpyrrolidone, poly(1-vinylpyrrolidone)-graft-(1-hexadecene), poly(1-vinylpyrrolidone)-graft-(1-triacontene), and poly(1-vinylpyrrolidone-co-acrylic acid).

The sterically bulky group of the stabilizer may be any suitable moiety that limits the extent of particle self-assembly to nanosized particles. It is understood that "sterically bulky group" is a relative term requiring comparison with the size of the precursor/pigment; a particular group may or may not be "sterically bulky" depending on the relative size between the particular group and the precursor/pigment. As used herein, the phrase "sterically bulky" refers to the spatial arrangement of a large group attached to a molecule.

Representative stabilizers to enable nanosized particles include but are not limited to, the following: mono and tri-esters of sorbitol (SPAN®'s) with palmitic acid (SPAN® 40), stearic acid (SPAN® 60) and oleic acid (SPAN® 85) where the aliphatic chain of the acid is considered sterically bulky; tartaric acid esters with cyclohexanol and Isofol 20 where the cyclohexane moiety and the branched chain of Isofol are considered sterically bulky; polymers such as polyvinylpyrrolidone, poly(1-vinypyrrolidone)-graft-(1-hexadecene), poly(1-vinylpyrrolidone)-graft-(1-triacontene), poly(1-vinylpyrrolidone-co-acrylic acid) where the polymeric chain in itself is considered sterically bulky.

The non-covalent chemical bonding between the functional moiety of the precursor/pigment and the complementary functional moiety of the stabilizer is, for example, afforded by van der Waals' forces, ionic bonding, hydrogen bonding, and/or aromatic pi-stacking bonding. In embodiments, the non-covalent bonding is ionic bonding and/or hydrogen bonding but excluding aromatic pi-stacking bonding. In embodiments, the non-covalent bonding may be predominately hydrogen bonding or may be predominately aromatic pi-stacking bonding, where the term "predominately" indicates in this case the dominant nature of association of the stabilizer with the pigment particle.

In embodiments, for the acid dissolution of the pigment, any suitable agent may be used to completely solubilize the pigment subjecting the solution to conditions, which re-precipitate the solubilized pigment into nano-sized particles. Representative examples include, but are not limited to, sulfuric acid, nitric acid, mono-, di-, and tri-halo acetic acids such as trifluoroacetic acid, dichloroacetic acid and the like, halogen acids such as hydrochloric acid, phosphoric acid and polyphosphoric acid, boric acid, and a variety of mixtures thereof.

Any suitable liquid medium may be used to carry out the re-precipitation of the benzothioxanthene pigment so as to afford nanoscale particles. Examples of suitable liquid media include, but are not limited to, the following organic liquids such as: N-methyl-2-pyrrolidinone, dimethyl sulfoxide, N,N-dimethylformamide, N,N-dimethylacetamide, sulfolane, hexamethylphosphoramide, among others.

Any liquid that will not dissolve the pigment may be used as an optional precipitating agent. Illustrative precipitating agents include, but are not limited to, alcohols such as methanol, ethanol, 1-propanol, 2-propanol, 1-butanol, 2-butanol;

water; tetrahydrofuran; ethyl acetate; hydrocarbon solvents such as hexanes, toluene, xylenes, and Isopar solvents; and mixtures thereof.

The steric stabilizer loading in the reaction may vary between about 5 to about 300 mol %, such as about 10 to about 150 mol %, or about 20 to about 70 mol % to pigment. Optionally, the solids concentration of the nanoscale pigment particle in the final precipitated mixture may vary from 0.5% to about 20% by weight such as from about 0.5% to about 10% by weight, or about 0.5% to about 5% by weight, but the actual value may also be outside these ranges.

In an embodiment, the crude benzothioxanthene pigment is first solubilized in an acidic liquid, such as, concentrated sulfuric acid, which is then added slowly under vigorous agitation to a second solution comprising a suitable solvent and a steric stabilizer compound, and optionally a minor amount of a surface-active agent or other common additive. During the addition, the temperature is maintained anywhere from about 0° C. to about 40° C., although the re-precipitation of benzothioxanthene pigment to form nanoscale particles may be held isothermally within or outside this temperature range in one embodiment and, in another embodiment, the temperature during re-precipitation of benzothioxanthene pigment to form nanoscale particles may also be allowed to cycle up and down within or outside this temperature range.

In an embodiment, a first solution is prepared or provided that comprises pigment particles dissolved or dispersed in a strong acid. The strong acid may be, for example, a mineral acid, an organic acid, or a mixture thereof. Examples of strong mineral acids include sulfuric acid, nitric acid, perchloric acid, various hydrohalic acids (such as hydrochloric acid, hydrobromic acid, and hydrofluoric acid), fluorosulfonic acid, chlorosulfonic acid, phosphoric acid, polyphosphoric acid, boric acid, mixtures thereof, and the like. Examples of strong organic acids include organic sulfonic acid, such as methanesulfonic acid and toluenesulfonic acid, acetic acid, trifluoroacetic acid, chloroacetic acid, cyanoacetic acid, mixtures thereof, and the like.

This first solution may include the strong acid in any desirable amount or concentration, such as to allow for desired dissolution or dispersion of the pigment particles. The acid solution contains pigment in a concentration of about 0.5% to about 20%, such as from about 1% to about 15% or from about 2% to about 10% by weight, although the values may also be outside these ranges.

In an embodiment, the second solution is prepared or provided that comprises the steric stabilizer. Suitable steric stabilizers include those described earlier, and may include others such as the surface-active agents described previously that have functional groups that also interact with the functional moieties of the pigment particles to provide additional stabilization. The steric stabilizer may be introduced in the form of a solution, where the steric stabilizer is either dissolved or finely suspended in a suitable liquid medium, such as water or polar organic solvents such as acetone, acetonitrile, ethyl acetate, alcohols such as methanol, ethanol, isopropanol, diethyl ether, tetrahydrofuran, N-methyl-2-pyrrolidinone, dimethyl sulfoxide, N,N-dimethylformamide, mixtures thereof, and the like. For example, a suitable liquid medium in an embodiment is a mixture of water and N-methyl-2-pyrrolidinone. Such mixtures may contain water and N-methylpyrrolidinone in a ratio of about 1:6 to about 1:3, and such as about 1:4.

In an embodiment, a precipitating agent, such as those described above, may also be incorporated into the second solution. Precipitating agents are liquids that do not solubilize the pigment and include, but are not limited to, water, alcohols such as methanol, ethanol and isopropanol and various mixtures thereof. The precipitating agent may be added in a range of about 10% to about 100% by volume out of the total volume of the mixture, such as between about 20% and about 80%, or between about 30% and about 70%.

The re-precipitation of the pigment to form nanoscale pigment particles may be conducted by adding the first (dissolved pigment) solution to the second (steric stabilizer) solution. This addition is conducted slowly by adding the first (dissolved pigment) solution to the second (steric stabilizer) solution under agitation by use of mechanical stirring or homogenization or other means. Methods of addition may include drop-wise from a suitable vessel, or spraying with or without the use of a nebulizing gas.

The re-precipitation process may be conducted at any desired temperature to allow for formation of nanoscale benzothioxanthene pigment particles while maintaining solubility of the first and second solutions. For example, the re-precipitation may be conducted at a temperature of from about 0° to about 90° C., such as from about 0° to about 60° C., or from about 0° to about 30° C., although temperatures outside of these ranges may be used. In one embodiment, the re-precipitation may be performed essentially isothermally, where a substantially constant temperature is maintained, while in another embodiment, the temperature during re-precipitation may be allowed to fluctuate within the above range, where the fluctuation may be cyclic or the like.

After addition of the first solution (dissolved pigment) to the second solution, it is believed that a non-covalent bonding interaction occurs between the functional moieties present on the pigment molecules and the functional groups of the steric stabilizer molecules, which creates a steric barrier that limits or prevents further aggregation of the pigment molecules. In this way, the pigment particle size and morphology, may be controlled and even tailored by providing steric stabilizer compositions and process conditions that limit pigment particle growth to a desired level.

Once the re-precipitation is complete, the pigment nanoscale particles may be separated from the solution by any conventional means, such as, vacuum-filtration methods or centrifugal separation methods. The nanoacale particles may also be processed for subsequent use according to known methods.

In an embodiment, acid dissolution and reconstitution may be performed utilizing a solution of pigment in, for example, concentrated sulfuric acid and the solution is added slowly with vigorous stirring to a solution of a suitable solvent containing the optimum amount of steric stabilizer. During the addition, the temperature is maintained at about 20° C. to below about 60° C., although the re-precipitation of benzothioxanthene into nanoscale particles may be held isothermally within or outside this temperature range in one embodiment and, in another embodiment, the temperature during re-precipitation of benzothioxanthene into nanoscale particles may also be allowed to cycle up and down within or outside this temperature range.

The formed nanoscale benzothioxanthene pigment particles may be used, for example, as coloring agents in a variety of compositions, such as in solid (or phase change) inks, or the like.

In a second embodiment toner compositions may also contain at least one "fluorescent organic nanoparticle" made by preparing a polymer latex by using an emulsion aggregation process. As used herein "fluorescent organic nanoparticle" describe a polymer matrix comprising one or more polymer resins, including one or more crosslinked resins, and one or more fluorescent dyes dispersed inside the resin matrix. The fluorescent organic nanoparticles are of a maximum size less than about 500 nm, such as less than about 200 nm, or less than about 100 nm as measured with a Nicomp Particle analyzer. In particular embodiments, the fluorescent organic nanoparticles are robust, hard particles and are dispersible in organic solvents.

Fluorescent dyes that may be used include any fluorescent dye that is soluble or dispersible in the polymer latex or emulsion. The one or more fluorescent dyes comprises from about 0.01 to about 50 weight percent to total weight of the nanoparticle, such as from about 1 to about 40 weight percent to total weight of the nanoparticle, or from about 3 to about 20 weight percent to total weight of the nanoparticle. Examples of suitable fluorescent dyes include, for example, aryl-acetylenes, 2,5-diaryl-oxazoles, 1,2,3-oxadiazoles, aryl-substituted 2-pyrazolidines, xanthones, thioxanthones and acridones, benzazoles, benzotriazoles, benzoquinolines, fluoresceine derivatives, derivatives of phenothiazine, phenoxazine, quinine derivatives (including quinine derivatives having fused aromatic rings), coumarins, indigo derivatives, derivatives of naphthalic anhydride and naphthalimide, perilenes and the like.

Other fluorescent dyes that may be used in the nanoparticles include fluorescent compounds or dyes that are invisible to the naked eye referred to herein as "invisible fluorescent dyes." Examples of such invisible fluorescent dyes include those that are invisible under ambient light but emit bright colors under black light, for example, those emitting green, yellow, red and orange light may also be used. Examples of such compounds include Near IR emitting compounds and dyes such as coordination compounds of organic lanthanides as described, for example, in U.S. Pat. No. 5,435,937, which is hereby incorporated by reference in its entirety. Near IR fluorescent lanthanides are fluorescence compounds which cannot be seen by the naked eye. Examples of IR emitting organic dyes are described, for example, in U.S. Pat. No. 5,093,147, which is hereby incorporated by reference in its entirety.

Suitable resins include, for example, an amorphous resin or a mixture of amorphous resins having a Tg over about 180° C., such as a Tg over about 200° C. or a Tg over about 220° C., an amorphous resin or mixture of amorphous resins with a Tg lower than about 180° C., such as a Tg over about 200° C. or a Tg over about 220° C. as long as a crosslinker is present so that the resulting Tg of the resin is higher than about 180° C., such as a Tg over about 200° C. or a Tg over about 220° C., and a crystalline polymer or crystalline polymer mixture as long as the melting temperature of the polymer binder is greater than about 180° C., such as the melting temperature of the polymer binder is greater than about 200° C. or the melting temperature of the polymer binder is greater than about 220° C.

Examples of other suitable resins include, for example, a polymer selected from the group consisting of poly(styrene-alkyl acrylate), poly(styrene-1,3-diene), poly(styrene-alkyl methacrylate), poly(styrene-alkyl acrylate-acrylic acid), poly(styrene-1,3-diene-acrylic acid), poly(styrene-alkyl methacrylate-acrylic acid), poly(alkyl methacrylate-alkyl acrylate), poly(alkyl methacrylate-aryl acrylate), poly(aryl methacrylate-alkyl acrylate), poly(alkyl methacrylate-acrylic acid), poly(styrene-alkyl acrylate-acrylonitrile-acrylic acid), poly(styrene-1,3-diene-acrylonitrile-acrylic acid), and poly(alkyl acrylate-acrylonitrile-acrylic acid); a process wherein the latex contains a resin selected from the group consisting of poly(styrene-butadiene), poly(methylstyrene-butadiene), poly(methyl methacrylate-butadiene), poly(ethyl methacrylate-butadiene), polypropyl methacrylate-butadiene), poly(butyl methacrylate-butadiene), poly(methyl acrylate-butadiene), poly(ethyl acrylate-butadiene), poly(propyl acrylate-butadiene), polybutyl acrylate-butadiene), poly(styrene-isoprene), poly(methylstyrene-isoprene), poly(methyl methacrylate-isoprene), poly(ethyl methacrylate-isoprene), poly(propyl methacrylate-isoprene), poly(butyl methacrylate-isoprene), poly(methyl acrylate-isoprene), poly(ethyl acrylate-isoprene), polypropyl acrylate-isoprene), poly(butyl acrylate-isoprene), poly(styrene-propyl acrylate), poly(styrene-butyl acrylate), poly(styrene-butadicne-acrylic acid), poly(styrene-butadiene-methacrylic acid), poly(styrene-butadiene-acrylonitrile-acrylic acid), poly(styrene-butyl acrylate-acrylic acid), poly(styrene-butyl acrylate-methacrylic acid), poly(styrene-butyl acrylate-acrylononitrile), and poly(styrene-butyl acrylate-acrylononitrile-acrylic acid), combinations thereof and the like. The resins may also be functionalized, such as carboxylated, sulfonated, or the like, and particularly such as sodio sulfonated, if desired.

Examples of suitable amorphous polyesters include, for example, polyethylene-terephthalate, polypropylene-terephthalate, polybutylene-terephthalate, polypentylene-terephthalate, polyhexalene-terephthalate, polyheptadene-terephthalate, polyoctalene-terephthalate, polyethylene-sebacate, polypropylene-sebacate, polybutylene-sebacate, polyethylene-adipate, polypropylene-adipate, polybutylene-adipate, polypentylene-adipate, polyhexalene-adipate, polyheptadene-adipate, polyoctalene-adipate, polyethylene-glutarate, polypropylene-glutarate, polybutylene-glutarate, polypentylene-glutarate, polyhexalene-glutarate, polyheptadene-glutarate, polyoctalene-glutarate, polyethylene-pimelate, polypropylene-pimelate, polybutylene-pimelate, polypentylene-pimelate, polyhexalene-pimelate, polyheptadene-pimelate, poly(propoxylated bisphenol-fumarate), polypropoxylated bisphenol-succinate), poly(propoxylated bisphenol-adipate), poly(propoxylated bisphenol-glutarate), SPAR™ (Dixie Chemicals), BECKOSOL™ (Reichhold Inc), ARAKOTE™ (Ciba-Geigy Corporation), HETRON™ (Ashland Chemical), PARAPLEX™ (Rohm & Hass), POLYLITE™ (Reichhold Inc), PLASTHALL™ (Rohm & Hass), CYGAL™ (American Cyanamide), ARMCO™ (Armco Composites), ARPOL™ (Ashland Chemical), CELANEX™ (Celanese Eng), RYNITE™ (DuPont), STYPOL™ (Freeman Chemical Corporation), combinations thereof and the like. The resins may also be functionalized, such as carboxylated, sulfonated, or the like, and particularly such as sodio sulfonated, if desired.

Illustrative examples of crystalline polymer resins include any of the various crystalline polyesters, such as poly(ethylene-adipate), poly(propylene-adipate), poly(butylene-adipate), poly(pentylene-adipate), poly(hexylene-adipate), poly(octylene-adipate), poly(ethylene-succinate), poly(propylene-succinate), poly(butylene-succinate), poly(pentylene-succinate), poly(hexylene-succinate), poly(octylene-succinate), poly(ethylene-sebacate), poly(propylene-sebacate), poly(butylene-sebacate), poly(pentylene-sebacate), poly(hexylene-sebacate), poly(octylene-sebacate), copoly(5-sulfoisophthaloyl)-copoly(ethylene-adipate), copoly(5-sulfoisophthaloyl)-copoly(propylene-adipate), copoly(5-sulfoisophthaloyl)-copoly(butylene-adipate), copoly(5-sulfo-isophthaloyl)-copoly(pentylene-adipate), copoly(5-sulfo-isophthaloyl)-copoly(hexylene-adipate), copoly(5-sulfo-isophthaloyl)-copoly(octylene-adipate), copoly(5-sulfo-isophthaloyl)-copoly(ethylene-adipate), copoly(5-sulfo-isophthaloyl)-copoly(propylene-adipate), copoly(5-sulfo-isophthaloyl)-copoly(butylene-adipate), copoly(5-sulfo-isophthaloyl)-copoly(pentylene-adipate), copoly(5-sulfo-isophthaloyl)-copoly (hexylene-adipate), copoly(5-sulfo-isophthaloyl)-copoly (octylene-adipate), copoly(5-sulfoisophthaloyl)-copoly (ethylene-succinate), copoly(5-sulfoisophthaloyl)-copoly (propylene-succinate), copoly(5-sulfoisophthaloyl)-copoly (butylene-succinate), copoly(5-sulfoisophthaloyl)-copoly (pentylene-succinate), copoly(5-sulfoisophthaloyl)-copoly (hexylene-succinate), copoly(5-sulfoisophthaloyl)-copoly (octylene-succinate), copoly(5-sulfo-isophthaloyl)-copoly (ethylene-sebacate), copoly(5-sulfo-isophthaloyl)-copoly (propylene-sebacate), copoly(5-sulfo-isophthaloyl)-copoly (butylenes-sebacate), copoly(5-sulfo-isophthaloyl)-copoly (pentylene-sebacate), copoly(5-sulfo-isophthaloyl)-copoly (hexylene-sebacate), copoly(5-sulfo-isophthaloyl)-copoly (octylene-sebacate), copoly(5-sulfo-isophthaloyl)-copoly (ethylene-adipate), copoly(5-sulfo-isophthaloyl)-copoly (propylene-adipate), copoly(5-sulfo-isophthaloyl)-copoly (butylene-adipate), copoly(5-sulfo-isophthaloyl)-copoly (pentylene-adipate), copoly(5-sulfo-isophthaloyl)-copoly (hexylene-adipate), and poly(octylene-adipate).

The crystalline resins may be prepared, for example, by a polycondensation process by reacting suitable organic diol(s) and suitable organic diacid(s) in the presence of a polycondensation catalyst. Generally, a stoichiometric equimolar ratio of organic diol and organic diacid is utilized; however, in some instances, where the boiling point of the organic diol is from about 180° C. to about 230° C., an excess amount of diol may be utilized and removed during the polycondensation process. The amount of catalyst utilized varies, and may be selected in an amount, for example, of from about 0.01 to about 1 mole percent of the resin. Additionally, in place of the organic diacid, an organic diester may also be selected, where an alcohol byproduct is generated.

Examples of organic diols include aliphatic diols with from about 2 to about 36 carbon atoms, such as 1,2-ethanediol, 1,3-propanediol, 1,4-butanediol, 1,5-pentanediol, 1,6-hexanediol, 1,7-heptanediol, 1,8-octanediol, 1,9-nonanediol, 1,10-decanediol, 1,12-dodecanediol, and the like; alkali sulfo-aliphatic diols such as sodio 2-sulfo-1,2-ethanediol, lithio 2-sulfo-1,2-ethanediol, potassio 2-sulfo-1,2-ethanediol, sodio 2-sulfo-1,3-propanediol, lithio 2-sulfo-1,3-propanediol, potassio 2-sulfo-1,3-propanediol, mixture thereof, and the like. The aliphatic diol is, for example, selected in an amount of from about 45 to about 50 mole percent of the resin, and the alkali sulfo-aliphatic diol may be selected in an amount of from about 1 to about 10 mole percent of the resin.

Examples of organic diacids or diesters selected for the preparation of the crystalline polyester resins include oxalic acid, succinic acid, glutaric acid, adipic acid, suberic acid, azelaic acid, sebacic acid, phthalic acid, isophthalic acid, terephthalic acid, napthalene-2,6-dicarboxylic acid, naphthalene-2,7-dicarboxylic acid, cyclohexane dicarboxylic acid, malonic acid, mesaconic acid, and diesters or anhydrides thereof and an alkali sulfo-organic diacid such as the sodio, lithio or potassium salt of dimethyl-5-sulfo-isophthalate, dialkyl-5-sulfo-isophthalate-4-sulfo-1,8-naphthalic anhydride, 4-sulfo-phthalic acid, dimethyl-4-sulfo-phthalate, dialkyl-4-sulfo-phthalate, 4-sulfophenyl-3,5-dicarbomethoxybenzene, 6-sulfo-2-naphthyl-3,5-dicarbomethoxybenzene, sulfo-terephthalic acid, dimethyl-sulfo-terephthalate, 5-sulfo-isophthalic acid, dialkyl-sulfo-terephthalate, sulfoethanediol, 2-sulfopropanediol, 2-sulfobutanediol, 3-sulfopentanediol, 2-sulfohexanediol, 3-sulfo-2-methylpentanediol, 2-sulfo-3,3-dimethylpentanediol, sulfo-p-hydroxybenzoic acid, N,N-bis(2-hydroxyethyl)-2-amino ethane sulfonate, or mixtures thereof. The organic diacid is selected in an amount of, for example, from about 40 to about 50 mole percent of the resin, and the alkali sulfoaliphatic diacid may be selected in an amount of from about 1 to about 10 mole percent of the resin.

Lincar amorphous polyester resins may be prepared, for example, by the polycondensation of an organic diol, a diacid or diester, and a polycondensation catalyst. For the branched amorphous sulfonated polyester resin, the same materials may be used, with the further inclusion of a branching agent such as a multivalent polyacid or polyol. The amorphous resin is present in various suitable amounts, such as from about 60 to about 90 weight percent, or from about 50 to about 65 weight percent, of the solids.

Examples of diacid or diesters selected for the preparation of amorphous polyesters include dicarboxylic acids or diesters selected from the group consisting of terephthalic acid, phthalic acid, isophthalic acid, fumaric acid, maleic acid, itaconic acid, succinic acid, succinic anhydride, dodecylsuccinic acid, dodecylsuccinic anhydride, glutaric acid, glutaric anhydride, adipic acid, pimelic acid, suberic acid, azelic acid, dodecanediacid, dimethyl terephthalate, diethyl terephthalate, dimethylisophthalate, diethylisophthalate, dimethylphthalate, phthalic anhydride, diethylphthalate, dimethylsuccinate, dimethylfumarate, dimethylmaleate, dimethylglutarate, dimethyladipate, dimethyl dodecylsuccinate, and mixtures thereof. The organic diacid or diester is selected, for example, from about 45 to about 52 mole percent of the resin. Examples of diols utilized in generating the amorphous polyester include 1,2-propanediol, 1,3-propanediol, 1,2-butanediol, 1,3-butanediol, 1,4-butanediol, pentanediol, hexanediol, 2,2-dimethylpropanediol, 2,2,3-trimethylhexanediol, heptanediol, dodecanediol, bis(hydroxyethyl)-bisphenol A, bis(2-hyroxypropyl)-bisphenol A, 1,4-cyclohexanedimethanol, 1,3-cyclohexanedimethanol, xylenedimethanol, cyclohexanediol, diethylene glycol, bis (2-hydroxyethyl) oxide, dipropylene glycol, dibutylene, and mixtures thereof. The amount of organic diol selected may vary, or, is, for example, from about 45 to about 52 mole percent of the resin.

Branching agents used in forming the branched amorphous sulfonated polyester include, for example, a multivalent polyacid such as 1,2,4-benzene-tricarboxylic acid, 1,2,4-cyclohexanetricarboxylic acid, 2,5,7-naphthalenetricarboxylic acid, 1,2,4-naphthalenetricarboxylic acid, 1,2,5-hexanetricarboxylic acid, 1,3-dicarboxyl-2-methyl-2-methylene-carboxylpropane, tetra(methylene-carboxyl)methane, and 1,2,7,8-octanetetracarboxylic acid, acid anhydrides thereof, and lower alkyl esters of the general formula RCOOR', where R and R' include from 1 to 6 carbon atoms; a multivalent polyol such as sorbitol, 1,2,3,6-hexanetetrol, 1,4-sorbitane, pentaerythritol, dipentaerythritol, tripentaerythritol, sucrose, 1,2,4-butanetriol, 1,2,5-pentatriol, glycerol, 2-methylpropanetriol, 2-methyl-1,2,4-butanetriol, trimethylolethane, trimethylolpropane, 1,3,5-trihydroxymethylbenzene, mixtures thereof, and the like. The branching agent amount selected is, for example, from about 0.1 to about 5 mole percent of the resin.

Examples of suitable polycondensation catalyst for either the crystalline or amorphous polyesters include tetraalkyl titanates, dialkyltin oxide such as dibutyltin oxide, tetraalkyltin such as dibutyltin dilaurate, dialkyltin oxide hydroxide such as butyltin oxide hydroxide, aluminum alkoxides, alkyl zinc, dialkyl zinc, zinc oxide, stannous oxide, or mixtures thereof; these catalysts are selected in amounts of, for example, from about 0.01 mole percent to about 5 mole percent based on the starting diacid or diester used to generate the polyester resin.

Linear or branched unsaturated polyesters selected for the in-situ preparation of the crosslinked particles and process of the present disclosure include low molecular weight condensation polymers that may be formed by step-wise reactions between both saturated and unsaturated diacids (or anhydrides) and dihydric alcohols (glycols or diols). The resulting unsaturated polyesters are reactive (for example, crosslinkable) on two fronts: (i) unsaturation sites (double bonds) along the polyester chain, and (ii) functional groups such as carboxyl, hydroxy, and the like groups amenable to acid-base reactions.

Typical unsaturated polyester resins useful for the present disclosure are prepared by melt polycondensation or other polymerization processes using diacids and/or anhydrides and diols.

Suitable diacids and dianhydrides include, but are not limited to, saturated diacids and/or dianhydrides such as for example succinic acid, glutaric acid, adipic acid, pimelic acid, suberic acid, azelaic acid, sebacic acid, isophthalic acid, terephthalic acid, hexachloroendo methylene tetrahydrophthalic acid, phthalic anhydride, chlorendic anhydride, tetrahydrophthalic anhydride, hexahydrophthalic anhydride, endomethylene tetrahydrophthalic anhydride, tetrachlorophthalic anhydride, tetrabromophthalic anhydride, and the like and mixtures thereof, and unsaturated diacids and/or anhydrides such as, for example, maleic acid, fumaric acid, chloromaleic acid, methacrylic acid, acrylic acid, itaconic acid, citraconic acid, mesaconic acid, maleic anhydride, and the like and mixtures thereof.

Suitable diols include, but are not limited to, for example, propylene glycol, ethylene glycol, diethylene glycol, neopentyl glycol, dipropylene glycol, dibromoneopentyl glycol, propoxylated bisphenol A, 2,2,4-trimethylpentane-1,3-diol, tetrabromo bisphenol dipropoxy ether, 1,4-butanediol, and the like and mixtures thereof. Preferred unsaturated polyester resins are prepared from diacids and/or anhydrides such as, for example, maleic anhydride, fumaric acid, and the like and mixtures thereof, and diols such as, for example, propoxylated bisphenol A, propylene glycol, and the like and mixtures thereof Monomers used in making the selected polymer are not limited, and the monomers utilized may include any one or more of, for example, ethylene, propylene, and the like. Known chain transfer agents, for example, dodecanethiol or carbon tetrabromide, may be utilized to control the molecular weight (Mw) properties of the polymer.

The resin or resins are included in the organic nanoparticle in an amount from about 50 to about 99.99 weight percent to total weight of the nanoparticle, such as from about 60 to about 99 weight percent to total weight of the nanoparticle, or from about 80 to about 97 weight percent to total weight of the nanoparticle. However, amounts outside of these ranges may be used in embodiments, depending upon the type and amounts of other materials present.

In a particular embodiment, forming the crosslinked resin emulsion is accomplished by dissolving the unsaturated polyester resin and an initiator in a suitable organic solvent under conditions that allow the solution to be formed. Suitable solvents that may be used include those in which the resin and any other optional components (such as a wax) are soluble, and that dissolves the resin component to form an emulsion, but which solvents may be subsequently evaporated-off to leave the resin in an emulsion, such as in water, at a specific particle size. For example, suitable solvents include alcohols, ketones, esters, ethers, chlorinated solvents, nitrogen containing solvents and mixtures thereof. Specific examples of suitable solvents include acetone, methyl acetate, methyl ethyl ketone, tetrahydrofuran, cyclohexanone, ethyl acetate, N,N dimethylformamide, dioctyl phthalate, toluene, xylene, benzene, dimethylsulfoxide, mixtures thereof, and the like. Particular solvents that may be used include acetone, methyl ethyl ketone, cyclohexanone, methyl acetate, ethyl acetate, dimethylsulfoxide, and mixtures thereof.

In an embodiment, the resin may be dissolved in the solvent at an elevated temperature, such as about 40 to about 80° C. or about 50 to about 70° or about 60 to about 65° C. In other embodiments, the temperature is lower than the glass transition temperature of the resin. In other embodiments, the resin is dissolved in the solvent at an elevated temperature, but below the boiling point of the solvent, such as at about 2 to about 15° C. or about 5 to about 10° C. below the boiling point of the solvent.

In addition to the resin and organic solvent, an initiator is included that subsequently crosslinks the resin. Any suitable initiator may be used such as, for example, free radical or thermal initiators such as organic peroxides and azo compounds. Examples of suitable organic peroxides include diacyl peroxides such as, for example, decanoyl peroxide, lauroyl peroxide and benzoyl peroxide; ketone peroxides such as, for example, cyclohexanone peroxide and methyl ethyl ketone; alkyl peroxyesters such as, for example, t-butyl peroxy neodecanoate, 2,5-dimethyl 2,5-di(2-ethyl hexanoyl peroxy)hexane, t-amyl peroxy 2-ethyl hexanoate, t-butyl peroxy 2-ethyl hexanoate, t-butyl peroxy acetate, t-amyl peroxy acetate, t-butyl peroxy benzoate, t-amyl peroxy benzoate, oo-t-butyl o-isopropyl mono peroxy carbonate, 2,5-dimethyl 2,5-di(benzoyl peroxy)hexane, oo-t-butyl o-(2-ethyl hexyl) mono peroxy carbonate, and oo-t-amyl o-(2-ethyl hexyl) mono peroxy carbonate; alkyl peroxides such as, for example, dicumyl peroxide, 2,5-dimethyl 2,5-di(t-butyl peroxy)hexane, t-butyl cumyl peroxide, α-α-bis(t-butyl peroxy)diisopropyl benzene, di-t-butyl peroxide and 2,5-dimethyl 2,5di(t-butyl peroxy)hexyne-3, alkyl hydroperoxides such as, for example, 2,5-dihydro peroxy 2,5-dimethyl hexane, cumene hydroperoxide, t-butyl hydroperoxide and t-aryl hydroperoxide; and alkyl peroxyketals such as, for example, n-butyl 4,4-di(t-butyl peroxy)valerate, 1,1-di(t-butyl peroxy)3,3,5-trimethyl cyclohexane, 1,1-di(t-butyl peroxy)cyclohexane, 1,1-di(t-amyl peroxy)cyclohexane, 2,2di(t-butyl peroxy)butane, ethyl 3,3-di(t-butyl peroxy)butyrate and ethyl 3,3-di(t-amyl peroxy)butyrate. Examples of suitable azo compounds include 2,2'-azobis(2,4-dimethylpentane nitrile, azobisisobutyronytrile, 2,2'-azobis(isobutyronitrile), 2,2'-azobis (2,4-dimethyl valeronitrile), 2,2'-azobis(methyl butyronitrile), 1,1'-azobis(cyano cyclohexane) and other similar known compounds.

Although any suitable initiator may be used, in particular embodiments the initiator is an organic initiator that is soluble in the solvent, but not soluble in water. Further, the initiator should be "substantially non-reactive" at temperatures up to about 65 to about 70° C. such that "substantially no crosslinking" takes place until after the resin-solvent phase is well dispersed in the water phase. As used herein, "substantially non-reactive" refers, for example, to "substantially no crosslinking" occurring between the polymer or resin material and the initiator which would affect the strength properties of the polymer or resin material. As used herein, "substantially no crosslinking" refers, for example, to less than about 1 percent, such as less than about 0.5 percent, or less than about 0.1 percent, cross linking between polymer chains in the resin.

In particular embodiments, a suitable amount of crosslinking monomer is added in order to provide improved robustness and hardness of the particles. Generally, the hardness of a particle correlates with the observed viscosity of a plurality of those particles. Therefore, an increase in the viscosity of a plurality of the particles would correspond to an increase in the hardness of the individual particles plurality of the particles.

In particular embodiments, substantially all of the initiator should react during a solvent flashing step when the mixture is raised to above about the boiling point of the solvent, such as about 80° C. or more, to flash off the residual solvent. Thus, the choice of initiator may be directed by its half-life/temperature characteristic. For example, half-life/temperature characteristic plots for Vazo® 52 (2,2'-azobis(2,4-dimethylpentane nitrile, E. I. du Pont de Nemours and Company, USA) shows a half-life greater than 90 minutes at 65° C. and less than 20 minutes at 80° C., which indicates that the initiator is particularly suitable for carrying out the crosslinking in the present solvent flashing process, because substantially no crosslinking takes place during the initial mixing phase of resin and solvent at 65° C. and substantially all of the crosslinking occurs during the solvent flashing step at temperatures up to 80° C.

The initiator may be included in any suitable amount to provide a specific degree of crosslinking. The initiator may be included in an amount of, for example, from about 0.1 to about 20 percent by weight of unsaturated resin, such as from about 0.5 or from about 1 to about 10 or about 15 percent by weight of unsaturated resin. In an embodiment, about 3 to about 6 percent by weight initiator is added.

In some embodiments, in situ crosslinking process utilizes an unsaturated resin such as, for example, an unsaturated amorphous linear or branched polyester resin. In other embodiments, the polymer matrix is prepared by thermal (radical) initiated crosslinking. Useful free-radical thermal initiators include, for example, azo, peroxide, persulfate, and redox initiators, and combinations thereof.

Suitable azo initiators include, for example, 2,2'-azobis(4-methoxy-2,4-dimethylvaleronitrile) (available under the trade designation "VAZO 33"), 2,2'-azobis(2-amidinopropane)dihydrochloride (available under the trade designation "VAZO 50"), 2,2-azobis(2,4-dimethylvaleronitrile) (available under the trade designation "VAZO 52"), 2,2'-azobis (isobutyronitrile) (available under the trade designation "VAZO 64"), 2,2'-azobis-2-methylbutyronitrile (available under the trade designation "VAZO 67"), and 1,1'-azobis(1-cyclohexanecarbonitrile) (available under the trade designation "VAZO 88"), all of which are available from E.I. du Pont de Nemours and Company, Wilmington, Del.; and 2,2'-azobis (methyl isobutyrate) (available under the trade designation "V-601" from Wako Pure Chemical Industries, Ltd., Osaka, Japan).

Suitable peroxide initiators include, for example, benzoyl peroxide, acetyl peroxide, lauroyl peroxide, decanoyl peroxide, dicetyl peroxydicarbonate, di(4-t-butylcyclohexyl)peroxydicarbonate (available under the trade designation "PERKADOX 16", from Akzo Chemicals, Chicago, Ill.), di(2-ethylhexyl)peroxydicarbonate, t-butylperoxypivalate (available under the trade designation "LUPERSOL 11", from Lucidol Division, Atochem North America, Buffalo, N.Y.); t-butylperoxy-2-ethylhexanoate (available under the trade designation "TRIGONOX 21-C50" from Akzo Chemicals), and dicumyl peroxide.

Suitable persulfate initiators include, for example, potassium persulfate, sodium persulfate, and ammonium persulfate.

Suitable redox (oxidation-reduction) initiators include, for example, combinations of persulfate initiators with reducing agents including, for example, sodium metabisulfite and sodium bisulfite; systems based on organic peroxides and tertiary amines (e.g., benzoyl peroxide plus dimethylaniline); and systems based on organic hydroperoxides and transition metals (e.g., cumene hydroperoxide plus cobalt naphthenate).

After the resin and initiator are dissolved in the solvent, the resin and initiator solution is mixed into an emulsion medium, for example water such as deionized water containing a stabilizer, and optionally a surfactant. Examples of suitable stabilizers include water-soluble alkali metal hydroxides, such as sodium hydroxide, potassium hydroxide, lithium hydroxide, beryllium hydroxide, magnesium hydroxide, calcium hydroxide, or barium hydroxide; ammonium hydroxide; alkali metal carbonates, such as sodium bicarbonate, lithium bicarbonate, potassium bicarbonate, lithium carbonate, potassium carbonate, sodium carbonate, beryllium carbonate, magnesium carbonate, calcium carbonate, barium carbonate or cesium carbonate; and mixtures thereof. In a particular embodiment, the stabilizer is sodium bicarbonate or ammonium hydroxide. When the stabilizer is used in the composition, it may be present at a level of from about 0.1 to about 5 percent, such as about 0.5 to about 3 percent by weight of the resin. In embodiments, when such salts are added to the composition as a stabilizer, incompatible metal salts are not present in the composition. For example, when these salts are used the composition may be completely or essentially free of zinc and other incompatible metal ions, e.g., Ca, Fe, Ba, etc., which form water-insoluble salts. The term "essentially free" refers, for example, to the incompatible metal ions as present at a level of less than about 0.01 percent, such as less than about 0.005 or less than about 0.001 percent by weight of the wax and resin. In particular embodiments, the stabilizer may be added to the mixture at ambient temperature, or it may be heated to the mixture temperature prior to addition.

Optionally, an additional stabilizer, such as a surfactant, maybe added to the aqueous emulsion medium such as to afford additional stabilization to the resin particles, particularly if wax is also included in the emulsion, albeit at a reduced level as compared to conventional wax emulsions. Suitable surfactants include anionic, cationic and nonionic surfactants. In embodiments, the use of anionic and nonionic surfactants may additionally help stabilize the aggregation process in the presence of the coagulant, which otherwise could lead to aggregation instability.

Anionic surfactants include sodium dodecylsulfate (SDS), sodium dodecyl benzene sulfonate, sodium dodecylnaphthalene sulfate, dialkyl benzenealkyl, sulfates and sulfonates, abitic acid, and the NEOGEN brand of anionic surfactants. An example of a suitable anionic surfactant is NEOGEN R-K available from Daiichi Kogyo Seiyaku Co. Ltd. (Japan), or TAYCAPOWER BN2060 from Tayca Corporation (Japan), which consists primarily of branched sodium dodecyl benzene sulfonate.

Examples of cationic surfactants include dialkyl benzene alkyl ammonium chloride, lauryl trimethyl ammonium chloride, alkylbenzyl methyl ammonium chloride, alkyl benzyl dimethyl ammonium bromide, benzalkonium chloride, cetyl pyridinium bromide, $C_{12}$, $C_{15}$, $C_{17}$ trimethyl ammonium bromides, halide salts of quaternized polyoxyethylalkylamines, dodecyl benzyl triethyl ammonium chloride, MIRAPOL and ALKAQUAT available from Alkaril Chemical Company, SANISOL (benzalkonium chloride) available from Kao Chemicals, and the like. An example of a suitable cationic surfactant is SANISOL B-50 available from Kao Corporation, which consists primarily of benzyl dimethyl alkonium chloride.

Examples of nonionic surfactants include polyvinyl alcohol, polyacrylic acid, methalose, methyl cellulose, ethyl cellulose, propyl cellulose, hydroxy ethyl cellulose, carboxy methyl cellulose, polyoxyethylene cetyl ether, polyoxyethylene lauryl ether, polyoxyethylene octyl ether, polyoxyethylene octylphenyl ether, polyoxyethylene oleyl ether, polyoxyethylene sorbitan monolaurate, polyoxyethylene stearyl ether, polyoxyethylene nonylphenyl ether, dialkylphenoxy poly(ethyleneoxy) ethanol, available from Rhone-Poulenc Inc. as IGEPAL CA-210, IGEPAL CA-520, IGEPAL CA-720, IGEPAL CO-890, IGEPAL CO-720, IGEPAL CO-290, IGEPAL CA-210, ANTAROX 890 and ANTAROX 897. An example of a suitable nonionic surfactant is ANTAROX 897 available from Rhone-Poulenc Inc., which consists primarily of alkyl phenol ethoxylate.

After the stabilizer or stabilizers are added, the resultant mixture may be mixed or homogenized for any specific time.

Next, the mixture is stirred and the solvent is evaporated off. Alternatively, the solvent may be flashed off. The solvent flashing may be conducted at any suitable temperature at or above about the boiling point of the solvent in water that will flash off the solvent, such as about 60 to about 100° C., for example, about 70 to about 90° C. or about 80° C., although the temperature may be adjusted based on, for example, the particular resin and solvent used.

Following the solvent evaporation (or flashing) step, the crosslinked polyester resin particles in embodiments have an average particle diameter in the range of about 20 to about 500 nm, such as from about 75 to 400 nm, or as from about 100 to about 200 nm as measured with a Nicomp Particle Analyzer.

The polyester resin latex or emulsion maybe prepared by any suitable means. For example, the latex or emulsion may be prepared by taking the resin and heating it to its melting temperature and dispersing the resin in an aqueous phase containing a surfactant. The dispersion may be carried out by various dispersing equipment such as ultimizer, high speed homogenizer, or the like to provide submicron resin particles. Other ways to prepare the polyester resin latex or emulsion include solubilizing the resin in a solvent and adding it to heated water to flash evaporate the solvent. External dispersion may also be employed to assist the formation of emulsion as the solvent is being evaporated. Polyester resin emulsions prepared by other means or methods may also be utilized in the preparation of the toner composition.

Illustrative examples of such latex polymers include, but are not limited to, poly(styrene-butadiene), poly(methyl methacrylate-butadiene), poly(ethyl methacrylate-butadiene), poly(propyl methacrylate-butadiene), poly(butyl methacrylate-butadiene), poly(methyl acrylate-butadiene), poly (ethyl acrylate-butadiene), poly(propyl acrylate-butadiene), poly(butyl acrylate-butadiene), poly(styrene-isoprene), poly (methylstyrene-isoprene), poly(methyl methacrylate-isoprene), poly(ethyl methacrylate-isoprene), poly(propyl methacrylate-isoprene), poly(butyl methacrylate-isoprene), poly(methyl acrylate-isoprene), poly(ethyl acrylate-isoprene), poly(propyl acrylate-isoprene), poly(butyl acrylate-isoprene), poly(styrene-butylacrylate), poly(styrene-butadiene), poly(styrene-isoprene), poly(styrene-butyl methacrylate), poly(styrene-butyl acrylate-acrylic acid), poly (styrene-butadiene-acrylic acid), poly(styrene-isoprene-acrylic acid), poly(styrene-butyl methacrylate-acrylic acid), poly(butyl methacrylate-butyl acrylate), poly(butyl methacrylate-acrylic acid), poly(styrene-butyl acrylate-acrylonitrile-acrylic acid), poly(acrylonitrile-butyl acrylate-acrylic acid), poly(styrene-butyl acrylate-2-carboxyethyl acrylate), poly(styrene-butadiene-2-carboxyethyl acrylate), poly(styrene-isoprene-2-carboxyethyl acrylate), poly(styrene-butyl methaerylate-2-carboxyethyl acrylate), poly(butyl methacrylate-butyl acrylate-2-carboxyethyl acrylate), poly(butyl methacrylate-2-carboxyethyl acrylate), poly(styrene-butyl acrylate-acrylonitrile-2-carboxyethyl acrylate), poly(acrylonitrle-butyl acrylate-2-carboxyethyl acrylate), branched/partially crosslinked copolymers of the above, and the like.

A third embodiment uses fluorescent toner compositions containing at least one "fluorescent organic nanoparticle" made by emulsion polymerization process. A latex emulsion comprised of polymer particles containing fluorescent material generated from the emulsion polymerization is prepared as follows. An anionic surfactant solution and de-ionized water is mixed in a stainless steel holding tank. The holding tank is then purged with nitrogen before transferring into the reactor. The reactor is then continuously purged with nitrogen while being stirred at 100 RPM. The reactor is then heated up to 80 degrees at a controlled rate, and held there. Separately a solution of ammonium persulfate initiator and de-ionized water is prepared.

Separately a monomer emulsion is prepared consisting of methyl methacrylate, diethyleneglycol dimethacrylate, and a fluorescent pigment, this monomer solution is combined an anionic surfactant and deionized water to form an emulsion. 1% of the above emulsion is then slowly fed into the reactor containing the aqueous surfactant phase at 80° C. to form the "seeds" while being purged with nitrogen. The initiator solution is then slowly charged into the reactor and after 10 minutes the rest of the emulsion is continuously fed in a using metering pump at a rate of 0.5%/min. Once all the monomer emulsion is charged into the main reactor, the temperature is held at 80° C. for an additional 2 hours to complete the reaction. Full cooling is then applied and the reactor temperature is reduced to 35° C. The product is collected into a holding tank.

As used herein "disperse," "dispersible," and "dispersion" refer to the ability of the individual nanoparticle(s) to exist in solution without completely dissociating into the representative individual molecules that assembled to form the individual nanoparticle(s).

The term "substantially colorless" as used herein refers to the transparency of the nanoscale fluorescent pigment particles and/or fluorescent organic nanoparticles dispersed in a solvent. Specifically, the nanoparticles are substantially colorless when a substantial portion of the individual nanoparticles dispersed in a solvent are undetectable upon visual inspection The "average" fluorescent organic nanoparticle size, typically represented as $D_{50}$, is defined as the median particle size value at the 50th percentile of the particle size distribution, wherein 50% of the particles in the distribution are greater than the $D_{50}$ particle size value and the other 50% of the particles in the distribution are less than the $D_{50}$ value. Average particle size may be measured by methods that use light scattering technology to infer particle size, such as Dynamic Light Scattering with a Nicomp Particle analyzer.

Geometric standard deviation is a dimensionless number that typically estimates a population's dispersion of a given attribute (for instance, particle size) about the median value of the population and is derived from the exponentiated value of the standard deviation of the log-transformed values. If the geometric mean (or median) of a set of numbers $\{A_1, A_2, \ldots, A_n\}$ is denoted as $\mu_g$, then the geometric standard deviation is calculated as:

$$\sigma_g = \exp\sqrt{\frac{\sum_{i=1}^{n}(\ln A_i - \ln\mu_g)^2}{n}}$$

The small size of the fluorescent organic nanoparticles permits the dye particles to be used with inkjet compositions while avoiding physical cogging of the ink jet nozzles.

The term "average particle diameter" as used herein refers to the average length of the nanoscale fluorescent pigment particle as derived from images of the particles generated by Transmission Electron Microscopy (TEM).

The term "average aspect ratio" as used herein refers to the average ratio of the length divided by the width (length: width) of the nanoscale fluorescent pigment particle as derived from images of the particles generated by TEM.

The term "nanoscale" as used herein refers to pigment particles having a maximum length of less than or equal to about $5\times10^2$ nm in addition to a maximum width of less than or equal to about $1\times10^2$ nm.

In conventional emulsion/aggregation/coalescence processes for preparing toners, latex emulsions of at least one resin, fluorescent nanoparticles and other optional components are combined to obtain a toner formulation at the start of the toner aggregation process. The latex emulsion is subjected to an emulsion/aggregation process, wherein the latex emulsion is allowed to aggregate to form aggregate particles. The latex emulsion may be mixed by any suitable method, including but not limited to agitation. The latex emulsion mixture may be heated, in embodiments, to a temperature at, above or below the glass transition temperature of the resin, to aggregate the particles. However, aggregation may also be achieved without heating the composition.

In embodiments, the resin is preferably selected from the group consisting of thermoset resins, curable resins, thermoplastic resins and mixtures thereof, although other suitable resins may also be used. Non-limiting examples of suitable resins include epoxy resins, poly-functional epoxy resins, polyol resins, polycarboxylic acid resins, poly (vinylidene fluoride) resins, polyester resins, carboxy-functional polyester resins, hydroxy-functional polyester resins, acrylic resins, functional acrylic resins, polyamide resins, polyolefin resins, plasticized polyvinyl chloride (PVC), polyester and poly (vinylidene fluoride), ionomers, styrene, copolymers comprising styrene and an acrylic ester and mixtures thereof.

Toner particles formed from any of the above resins or combinations of resins in various exemplary embodiments may or may not be cross-linked. Any suitable cross-linking agent may be used, as desired. Suitable cross-linking agents include, but are not limited to, amines, anhydrides, isocyanates, divinyl benzene, divinyl toluene, diacrylates, dimethacrylates, and the like.

The latex emulsion of resin may be formed by forming a latex of at least one resin, selected from those described above, in water. The resin may be prepared by bulk polymerization or by a polycondensation process, and in which the resin is rendered hydrophilic by incorporation of alkali sulfonated monomers, for instance, as disclosed in U.S. Pat. Nos. 5,593,807 and 5,945,245, each of which is incorporated herein by reference in its entirety, and in which the resin selected may contain functional groups that render them dissipatable; that is, they form spontaneous emulsions in water without the use of organic solvents, especially above the glass transition temperature, Tg, of the resin. In other embodiments, the resin selected may require the use of organic solvents miscible with water, followed by an emulsification process in water and then followed by stripping the solvent from water to form an aqueous resin dispersion. The latex of suspended resin particles may be comprised of particles that have an average size of, for example, from about 5 to about 500 nanometers and, in embodiments, from about 10 to about 250 nanometers in volume average diameter, as measured by any suitable device such as, for example, a NiCOMP® sizer. The particles may comprise, for example, about 5 to about 40 percent by weight of the latex emulsion.

Alternatively, the latex maybe formed by emulsion polymerization. Techniques for emulsion polymerization are known in the art and are described in, for example, U.S. Pat. Nos. 6,458,501 and 5,853,943, each of which is incorporated herein by reference in its entirety. Synthesized acrylic and methacrylic acid-containing acrylic emulsions, glycidyl methacrylate functional acrylic emulsions, carboxylic acid-terminated dissipatible polyester emulsions and commercial epoxy resin emulsions provide materials that may also be used.

Resin is generally present in the toner in any sufficient, but effective, amount. In embodiments, resin may be present in an amount of from about 50 to about 100 percent by weight of a toner composition. In embodiments, resin may be present in an amount of from about 70 to about 90 percent by weight of the toner composition.

Illustrative examples of specific latex for resin, polymer or polymers selected for the toner of the present invention include, for example, poly(styrene-alkyl acrylate), poly(styrene-1,3-diene), poly(styrene-alkyl methacrylate), poly(styrene-alkyl acrylate-acrylic acid), poly(styrene-1,3-diene-acrylic acid), poly(styrene-alkyl methacrylate-acrylic acid), poly(alkyl methacrylate-alkyl acrylate), poly(alkyl methacrylate-aryl acrylate), poly(aryl methacrylate-alkyl acrylate), poly(alkyl methacrylate-acrylic acid), poly(styrene-alkyl acrylate-acrylonitrile-acrylic acid), poly(styrene-1,3-diene-acrylonitrile-acrylic acid), poly(alkyl acrylate-acrylonitrile-acrylic acid), poly(styrene-butadiene), poly (methylstyrene-butadiene), poly(methyl methacrylate-butadiene), poly(ethyl methacrylate-butadiene), poly(propyl methacrylate-butadiene), poly(butyl methacrylate-butadiene), poly(methyl acrylate-butadiene), poly(ethyl acrylate-butadiene), poly(propyl acrylate-butadiene), poly(butyl acrylate-butadiene), poly(styrene-isoprene), poly(methylstyrene-isoprene), poly(methyl methacrylate-isoprene), poly(ethyl methacrylate-isoprene), poly(propyl methacrylate-isoprene), poly(butyl methacrylate-isoprene), poly(methyl acrylate-isoprene), poly(ethyl acrylate-isoprene), poly(propyl acrylate-isoprene), and poly(butyl acrylate-isoprene); poly(styrene-propyl acrylate), poly(styrene-butyl acrylate), poly(styrene-butadiene-acrylic acid), poly(styrene-butadiene-methacrylic acid), poly(styrene-butadiene-acrylonitrile-acrylic acid), poly(styrene-butyl acrylate-acrylic acid), poly(styrene-butyl acrylate-methacrylic acid), poly(styrene-butyl acrylate-acrylonitrile), poly(styrene-butyl acrylate-acrylonitrile-acrylic acid), and other similar polymers.

As the latex emulsion polymer of the toner of embodiments, a styrene-alkyl acrylate may be used. In further embodiments, the styrene-alkyl acrylate is a styrene/n-butyl acrylate copolymer resin or a styrene-butyl acrylate beta-carboxyethyl acrylate polymer.

The latex polymer may be present in an amount of from about 70 to about 95 percent by weight of the toner particles (i.e., toner particles exclusive of external additives) on a solids basis, or from about 75 to about 85 percent by weight of the toner.

The monomers used in making the selected polymer are not limited, and the monomers utilized may include any one or more of, for example, styrene, acrylates such as methacrylates, butylacrylates, β-carboxy ethyl acrylate (β-CEA), etc., butadiene, isoprene, acrylic acid, methacrylic acid, itaconic acid, acrylonitrile, benzenes such as divinylbenzene, etc., and the like. Known chain transfer agents, for example dodecanethiol or carbon tetrabromide, may be utilized to control the molecular weight properties of the polymer. Any suitable method for forming the latex polymer from the monomers may be used without restriction.

In embodiments, additional additives may be incorporated, optionally in the form of dispersions, to the latex emulsion of resin prior to aggregation. Additives may be added, in embodiments, for any of various reasons, including, but not limited to, providing color, improving charging characteristics and improving flow properties. For example, additives including, but not limited to, colorants; magnetites; waxes; curing agents; charge additives; flow-promoting agents, such as silicas; flow-control agents; surfactants; plasticizers; stabilizers, such as stabilizers against UV degradation; antigassing and degassing agents, such as benzoin, surface additives; antioxidants; UV absorbers; light stabilizers; flocculates and aggregating agents; and fillers may be included.

The fluorescent nanoparticles of the embodiment may be incorporated in an amount sufficient to impart the desired color to the toner. In general, fluorescent nanoparticles may be employed in an amount ranging from about 2 percent to about 35 percent by weight of the toner particles on a solids basis, or from about 5 percent to about 25 percent by weight or even from about 5 percent to about 15 percent by weight.

In embodiments, a colorant is optionally present. As examples of suitable colorants, mention may be made of carbon black such as REGAL 330; magnetites, such as Mobay magnetites MO08029, MO8060; Columbian magnetites; MAPICO BLACKS and surface treated magnetites; Pfizer magnetites CB4799, CB5300, CB5600, MCX6369; Bayer magnetites, BAYFERROX 8600, 8610; Northern Pigments magnetites, NP-604, NP-608; Magnox magnetites TMB-100, or TMB-104; and the like. As colored pigments, there can be selected cyan, magenta, yellow, red, green, brown, blue or mixtures thereof. Specific examples of pigments include phthalocyanine HELIOGEN BLUE L6900, D6840, D7080, D7020, PYLAM OIL BLUE, PYLAM OIL YELLOW, PIGMENT BLUE I available from Paul Uhlich & Company, Inc., PIGMENT VIOLET 1, PIGMENT RED 48, LEMON CHROME YELLOW DCC 1026, E.D. TOLUIDINE RED and BON RED C available from Dominion Color Corporation, Ltd., Toronto, Ontario, NOVAPERM YELLOW FGL, HOSTAPERM PINK E from Hoechst, and CINQUASIA MAGENTA available from E.I. DuPont de Nemours & Company, and the like. Generally, colorants that can be selected are black, cyan, magenta, or yellow, and mixtures thereof. Examples of magentas are 2,9-dimethyl-substituted quinacridone and anthraquinone dye identified in the Color Index as CI 60710, CI Dispersed Red 15, diazo dye identified in the Color Index as CI 26050, CI Solvent Red 19, and the like. Illustrative examples of cyans include copper tetra(octadecyl sulfonamido) phthalocyanine, x-copper phthalocyanine pigment listed in the Color Index as CI 74160, CI Pigment Blue, and Althrathrene Blue, identified in the Color Index as CI 69810, Special Blue X-2137, and the like. Illustrative examples of yellows are diarylide yellow 3,3-dichlorobenzidene acetoacetanilides, a monoazo pigment identified in the Color Index as CI 12700, CI Solvent Yellow 16, a nitrophenyl amine sulfonamide identified in the Color Index as Foron Yellow SE/GLN, CI Dispersed Yellow 33 2,5-dimethoxy-4-sulfonanilide phenylazo-4'-chloro-2,5-dimethoxy acetoacetanilide, and Permanent Yellow FGL. Colored magnetites, such as mixtures of MAPICO BLACK, and cyan components may also be selected as colorants. Other known colorants can be selected, such as Levanyl Black A-SF (Miles, Bayer) and Sunsperse Carbon Black LHD 9303 (Sun Chemicals).

In embodiments, magnetites maybe included, either for their magnetic properties, or for the fluorescent nanoparticles, or both. Magnetites that may be used in toner compositions of embodiments include, but are not limited to, a mixture of iron oxides ($FeO.Fe_2O_3$), including those commercially available as Mobay magnetites MO8029™, MO8060™; Columbian magnetites; MAPICO BLACKS™ and surface-treated magnetites; Pfizer magnetites CB4799™, CB5300™, CB5600™, MCX6369™; Bayer magnetites, BAYFERROX 8600™, 8610™; Northern Pigments magnetites, NP-604™, NP-608™; Magnox magnetites TMB-100™, or TMB-104™; and the like. In embodiments, a magnetite may be present in a toner composition in an effective amount. In embodiments, the magnetite is present in an amount of from about 10 percent by weight to about 75 percent by weight of the toner composition. In embodiments, the magnetite is present in an amount of from about 30 percent by weight to about 55 percent by weight of the toner composition.

The toner compositions of embodiments may include suitable waxes. In embodiments, wax may be present in a toner composition in an amount of about 0.01 percent by weight to about 9 percent by weight, based on the weight of the toner composition. In embodiments, the wax is present in the toner composition in an amount of about 0.1 percent by weight to about 5 percent by weight, or about 1 percent by weight to about 3.55 percent by weight, based on the weight of the toner composition.

To incorporate wax into a toner composition, it is generally necessary for the wax to be in the form of an aqueous emulsion or dispersion of solid wax particles in water. Emulsions, by the classical definition, are mixtures of two immiscible liquids stabilized by an emulsifier, and therefore, in the case of wax, exist only when the wax is in its molten state as the emulsion is formed. However, the terminology "wax emulsion" is widely used in the industry and herein to describe both true wax emulsions and dispersions of solid wax in solvents, such as water. The wax emulsions of embodiments comprise submicron wax particles of from about 50 to about 500 nanometers, or of from about 100 to about 350 nanometers, suspended in an aqueous water phase containing an ionic surfactant. The ionic surfactant may be present in an amount of from about 0.5 percent by weight to about 10 percent by weight, and of from about 1 percent by weight to about 5 percent by weight of the wax.

The wax emulsions according to embodiments of the present invention comprise a wax selected from a natural vegetable waxes, natural animal waxes, mineral waxes, synthetic waxes and functionalized waxes. Examples of natural vegetable waxes include, for example, carnauba wax, candelilla wax, Japan wax, and bayberry wax. Examples of natural animal waxes include, for example, beeswax, punic wax, lanolin, lac wax, shellac wax, and spermaceti wax. Mineral waxes include, for example, paraffin wax, microcrystalline wax, montan wax, ozokerite wax, ceresin wax, petrolatum wax, and petroleum wax. Synthetic waxes include, for example, Fischer-Tropsch wax, acrylate wax, fatty acid amide wax, silicone wax, polytetrafluoroethylene wax, polyethylene wax, and polypropylene wax, and mixtures thereof. Examples of waxes of embodiments include polypropylenes and polyethylenes commercially available from Allied Chemical and Baker Petrolite, wax emulsions available from Michelman Inc. and the Daniels Products Company, EPOLENE N-15 commercially available from Eastman Chemical Products, Inc., VISCOL 550-P, a low weight average molecular weight polypropylene available from Sanyo Kasei K.K., and similar materials. The commercially available polyethylenes usually possess a molecular weight Mw of from about 1,000 to about 1,500, while the commercially available polypropylenes utilized have a molecular weight of about 4,000 to about 5,000. Examples of functionalized waxes include amines, amides, imides, esters, quaternary amines, carboxylic acids or acrylic polymer emulsion, for example, JONCRYL 74, 89, 130, 537, and 538, all available from Johnson Diversey, Inc., chlorinated polypropylenes and polyethylenes commercially available from Allied Chemical and Petrolite Corporation and JohnsonDiversey, Inc. Many of the polyethylene and polypropylene compositions useful in embodiments are illustrated in British Pat. No. 1,442,835, the entire disclosure of which is incorporated herein by reference.

Curing agents that may be mentioned for use in accordance with embodiments include epoxy phenol novolacs and epoxy cresol novolacs; isocyanate curing agents blocked with oximes, such as isopherone diisocyanate blocked with methyl ethyl ketoxime, tetramethylene xylene diisocyanate blocked with acetone oxime, and Desmodur W (dicyclohexylmethane diisocyanate curing agent) blocked with methyl ethyl ketoxime; light-stable epoxy resins such as SANTOLINK LSE 120 supplied by Monsanto; alicyclic poly-epoxides such as EHPE-3 150 supplied by Daicel; polyfunctional amines; dicyanodiamide; bisphenol A; bisphenol S; hydrogenated bisphenol; polyphenolics; imidazoles, such as 2-methyl imidazole and 2-phenyl imidazole; betahydroxy-alkylamide; uretdione; and polyfunctional isocyanates, such as 2,4-toluene diisocyanate, 2,6-toluene diisocyanate, alkaline diisocyanates, xylene-diisocyanate, isophorone-diisocyanate, methylene-bis(4-phenyl isocyanate),methylene-bis-(4-cyclohexyl)isocyanate, 3,3'-bitoluene-4-4'-diisocyanate, hexamethylene-diisocyanate, and naphthalene 1,5-diisocyanate; as well as other known or later developed curing agents and initiators, and mixtures thereof.

In embodiments, a charge additive maybe used in suitable effective amounts. In embodiments, the charge additive is used in amounts Torn about 0.1 percent by weight to about 15 percent by weight of the toner composition. In embodiments, the charge additive is used in amounts from about 1 percent by weight to about 15 percent by weight of the toner composition. In embodiments, the charge additive is used in amounts from about 1 percent by weight to about 3 percent by weight of the toner composition. Suitable charge additives in embodiments include, but are not limited to, alkyl pyridinium halides, bisulfates, the charge control additives of U.S. Pat. Nos. 3,944,493; 4,007,293; 4,079,014; 4,394,430 and 4,560,635, the disclosures of which are incorporated herein by reference in their entirety, negative charge enhancing additives, such as, for example, aluminum complexes, and other charge additives known in the art or later discovered or developed.

In addition, the toners may also optionally contain a coagulant and/or flow agents, such as colloidal silica. Suitable optional coagulants include any coagulant known or used in the art, including the well known coagulants polyaluminum chloride (PAC) and/or polyaluminum sulfosilicate (PASS). A preferred coagulant is polyaluminum chloride. The coagulant is present in the toner particles, exclusive of external additives and on a dry weight basis, in amounts of from 0 to about 3% by weight of the toner particles, preferably from about greater than 0 to about 2% by weight of the toner particles. The flow agent, if present, may be any colloidal silica such as SNOWTEX OL colloidal silica, SNOWTEX OS colloidal silica, and/or mixtures thereof The colloidal silica is present in the toner particles, exclusive of external additives and on a dry weight basis, in amounts of from 0 to about 15% by weight of the toner particles, preferably from about greater than 0 to about 10% by weight of the toner particles.

The toner may also include additional known positive or negative charge additives in effective suitable amounts of, for example, from about 0.1 to about 5 weight percent of the toner, such as quaternary ammonium compounds inclusive of alkyl pyridinium halides, bisulfates, organic sulfate and sulfonate compositions such as disclosed in U.S. Pat. No. 4,338,390, cetyl pyridinium tetrafluoroborates, distearyl dimethyl ammonium methyl sulfate, aluminum salts or complexes, and the like.

Also, in preparing the toner by the emulsion aggregation procedure, one or more surfactants may be used in the process. Suitable surfactants include anionic, cationic and nonionic surfactants. Surfactants for the preparation of latexes and other dispersions may be ionic or nonionic surfactants in an amount of about 0.01 percent by weight to about 15 percent by weight, or about 0.01 percent by weight to about 5 percent by weight, of the reaction mixture.

Anionic surfactants include sodium dodecylsulfate (SDS), sodium dodecyl benzene sulfonate, sodium dodecylnaphthalene sulfate, dialkyl benzenealkyl, sulfates and sulfonates, abitic acid, and the NEOGEN brand of anionic surfactants. An example of a preferred anionic surfactant is NEOGEN RK available from Daiichi Kogyo Seiyaku Co. Ltd., or TAYCA POWER BN2060 from Tayca Corporation (Japan), which consists primarily of branched sodium dodecyl benzene sulphonate.

Examples of cationic surfactants include dialkyl benzene alkyl ammonium chloride, lauryl trimethyl ammonium chloride, alkylbenzyl methyl ammonium chloride, alkyl benzyl dimethyl ammonium bromide, benzalkonium chloride, cetyl pyridinium bromide, $C_{12}$, $C_{15}$, $C_{17}$ trimethyl ammonium bromides, halide salts of quaternized polyoxyethylalkylamines, dodecyl benzyl triethyl ammonium chloride, MIRAPOL and ALKAQUAT available from Alkaril Chemical Company, SANISOL (benzalkonium chloride), available from Kao Chemicals, and the like. An example of a preferred cationic surfactant is SANISOL B-50 available from Kao Corp., which consists primarily of benzyl dimethyl alkonium chloride.

Examples of nonionic surfactants include polyvinyl alcohol, polyacrylic acid, methalose, methyl cellulose, ethyl cellulose, propyl cellulose, hydroxy ethyl cellulose, carboxy methyl cellulose, polyoxyethylene cetyl ether, polyoxyethylene lauryl ether, polyoxyethylene octyl ether, polyoxyethylene octylphenyl ether, polyoxyethylene oleyl ether, polyoxyethylene sorbitan monolaurate, polyoxyethylene stearyl ether, polyoxyethylene nonylphenyl ether, dialkylphenoxy poly(ethyleneoxy) ethanol, available from Rhone-Poulenc Inc. as IGEPAL CA-210, IGEPAL CA-520, IGEPAL CA-720, IGEPAL CO-890, IGEPAL CO-720, IGEPAL CO-290, IGEPAL CA-210, ANTAROX 890 and ANTAROX 897. An example of a preferred nonionic surfactant is ANTAROX 897 available from Rhone-Poulenc Inc., which consists primarily of alkyl phenol ethoxylate.

The toner compositions of embodiments may also include fillers, such as, for example, quartz; silicates; aluminosilicates; corundum; ceramic fillers; glass; carbonates, such as chalk, kaolin; inorganic fibers and the like; calcium sulfate; barium sulfate; magnesium sulfate; and any other known or later developed filler materials. The fillers may be included in amounts suitable to adjust the rheological characteristics of the toner composition.

Any suitable emulsion aggregation procedure may be used in forming the emulsion aggregation toner particles without restriction. In embodiments, these procedures typically include the basic process steps of at least aggregating an emulsion containing binder, one or more fluorescent nanoparticles, optionally one or more surfactants, optionally a wax emulsion, optionally a coagulant and one or more additional optional additives to form aggregates, subsequently coalescing or fusing the aggregates, and then recovering, optionally washing and optionally drying the obtained emulsion aggregation toner particles.

An example emulsion/aggregation/coalescing process of embodiments includes forming a mixture of latex binder, fluorescent nanoparticles, optional additive dispersions or emulsions, optional coagulant and deionized water in a vessel. The mixture is then stirred using a homogenizer until homogenized and then transferred to a reactor where the homogenized mixture is heated to a temperature of, for example, about 50° C. and held at such temperature for a period of time to permit aggregation of toner particles to the desired size. Once the desired size of aggregated toner particles is achieved, the pH of the mixture is adjusted in order to inhibit further toner aggregation. The toner particles are further heated to a temperature of, for example, about 90° C. and the pH lowered in order to enable the particles to coalesce and spherodize. The heater is then turned off and the reactor mixture allowed to cool to room temperature, at which point the aggregated and coalesced toner particles are recovered and optionally washed and dried.

In embodiments, dilute solutions of flocculates or aggregating agents may be used to optimize particle aggregation time with as little fouling and coarse particle formation as possible.

In particular embodiments, flocculates are included in an amount from about 0.01 percent by weight to about 10 percent by weight of the toner composition. Flocculates used in various embodiments include, but are not limited to, polyaluminum chloride (PAC), dialkyl benzenealkyl ammonium chloride, lauryl trimethyl ammonium chloride, alkylbenzyl methyl ammonium chloride, alkyl benzyl dimethyl ammonium bromide, benzalkonium chloride, cetyl pyridinium bromide, $C_{12}$, $C_{15}$, $C_{17}$ trimethyl ammonium bromides, halide salts of quaternized polyoxyethylalkylamines, dodecylbenzyl triethyl ammonium chloride, MIRAPOL™ and ALKAQUAT™ (available from Alkaril Chemical Company), SANIZOL™ (benzalkonium chloride) (available from Kao Chemicals), and the like, and mixtures thereof.

Any aggregating agent capable of causing complexation might suitably be used. Both alkali earth metal or transition metal salts may be utilized as aggregating agents. Examples of the alkali (II) salts that may be selected to aggregate the sodio sulfonated polyester colloid with a colorant to enable the formation of the toner composite are preferably selected from beryllium chloride, beryllium bromide, beryllium iodide, beryllium acetate, beryllium sulfate, magnesium chloride, magnesium bromide, magnesium iodide, magnesium acetate, magnesium sulfate, calcium chloride, calcium bromide, calcium iodide, calcium acetate, calcium sulfate, strontium chloride, strontium bromide, strontium iodide, strontium acetate, strontium sulfate, barium chloride, barium bromide, and barium iodide. Examples of transition metal salts or anions include acetates, acetoacetates, sulfates of vanadium, niobium, tantalum, chromium, molybdenum, tungsten, manganese, iron, ruthenium, cobalt, nickel, copper, zinc, cadmium, silver or aluminum salts such as aluminum acetate, polyaluminum chloride, aluminum halides, mixtures thereof and the like, and wherein the concentration thereof is optionally in the range of from about 0.1 percent by weight to about 5 percent by weight of water. In embodiments, the aggregating agent is selected from zinc acetate and polyaluminum chlorides.

Following addition of the optional flocculate or aggregating agent into the vessel, the aggregation step conditions may be continued for a period of time until toner composition particles of the desired size and size distribution are obtained. The size may be monitored by taking samples from the vessel and evaluating the size of the toner composition particles, for example with a particle sizing apparatus. In various exemplary embodiments of the invention, the aggregate particles have volume average diameter of less than 30 microns, from about 1 to about 25 microns, or from about 3 to about 10 microns, and narrow GSD of, for example, from about 1.10 to about 1.25, or from about 1.10 to about 1.20, as measured by a particle sizing apparatus, such as a particle sizing apparatus which makes use of the Coulter principle, such as a COULTER COUNTER, may be obtained.

Once the aggregate particles reach the desired size, the resulting suspension is allowed to coalesce. This may be achieved by heating to a temperature at or above the glass transition temperature of the resin.

These particles may be removed from the suspension, such as by filtration, and subjected to washing/rinsing with, for example, water to remove residual aggregating agent, and drying, to obtain toner composition particles comprised of resin, wax and optional additives, such as colorants and curing agents. In addition, the toner composition particles may be subjected to screening and/or filtration steps to remove undesired coarse particles from the toner composition.

In embodiments, washing may be carried out at a pH of from about 7 to about 12, and, in embodiments, at a pH of from about 9 to about 11, at a temperature of from about 45 to about 70° C., or from about 50 to about 70° C. The washing may comprise filtering and reslurrying a filter cake comprised of toner particles in deionized water. The filtering and reslurrying may be washed one or more times by deionized water, or washed by a single deionized water wash at a pH of about 4 wherein the pH of the slurry is adjusted with an acid, and followed optionally by one or more deionized water washes.

The toner composition of embodiments comprises toner particles having a volume average diameter of less than about 30 microns, such as from about 1 to about 15 microns, or from about 3 to about 10 microns, and a particle size distribution of less than about 1.25, such as from about 1.0 to about 1.25, or from about 1.15 to about 1.20; each measured, for example, with a particle sizing apparatus, such as a particle sizing apparatus which makes use of the Coulter principle, such as a COULTER COUNTER, wherein the toner has stable triboelectric charging performance. A narrow particle size distribution enables a clean transfer of toner particles, thereby providing enhanced resolution of the resulting developed fused images. The toner particles of embodiments may comprise a small particle size and narrow size distribution.

In embodiments, the toner composition may incorporate, for example by dry-blending, one or more external surface additive, such as fluidity-assisting additives, for example, those disclosed in WO 94/11446, curing agents; flow-promoting and flow-control agents; charge additives, such as those described above; and fillers such as aluminum oxide and silica, either singly or in combination. In addition, other additives may be included.

The toner compositions of the present invention may also optionally be blended with flow-promoting and flow-control agents, such as external additive particles, which are usually present on the surface of the toner compositions. Examples of these additives include, but are not limited to, metal oxides such as titanium oxide, tin oxide, mixtures thereof and the like; colloidal silicas such as AEROSIL®; metal salts and metal salts of fatty acids including zinc stearate, aluminum oxides, cerium oxides; and mixtures thereof. In embodiments, these flow-aid agents may be present in amounts of from about 0.1 percent by weight to about 5 percent by weight, and in amounts of from about 0.1 percent by weight to about 1 percent by weight. Several of the aforementioned additives are illustrated in U.S. Pat. Nos. 3,590,000 and 3,800,588, the disclosures of which are incorporated herein by reference in their entirety.

The total content of dry-blended additives incorporated with the toner composition of embodiments may be in the range of from about 0.01 percent by weight to about 10 percent by weight, and in some embodiments, may be in the range of from about 0.1 percent by weight to about 1.0 percent by weight, based on the total weight of the composition without the additives. However, higher or lower amounts of additives may also be used.

The toner particles of embodiments may be blended with external additives following formation. Any suitable surface additives may be used in embodiments. In particular embodiments, one or more of $SiO_2$, metal oxides such as, for example, $TiO_2$ and aluminum oxide, and a lubricating agent such as, for example, a metal salt of a fatty acid, for example, zinc stearate or calcium stearate, or long chain alcohols such as UNILIN 700, may be used as external surface additives. In general, silica is applied to the toner surface for toner flow, tribo enhancement, admix control, improved development and transfer stability and higher toner blocking temperature. $TiO_2$ is applied for improved relative humidity (RH) stability, tribo control and improved development and transfer stability. Zinc stearate may also used as an external additive for the toners of embodiments, the zinc stearate providing lubricating properties. Zinc stearate provides developer conductivity and tribo enhancement, both due to its lubricating nature. In addition, zinc stearate enables higher toner charge and charge stability by increasing the number of contacts between toner and carrier particles. Calcium stearate and magnesium stearate provide similar functions. The external surface additives of embodiments may be used with or without a coating.

In certain embodiments, the toners contain from, for example, about 0.1 to about 5 percent by weight of titania, about 0.1 to about 8 percent by weight of silica and about 0.1 to about 4 percent by weight of zinc stearate.

The process of the present invention may be used to produce toner particles within any sized reactor, and is thus commercially significant. Scaling up of the process from bench reactors to larger reactors may be readily achieved by practitioners in the art.

Developer compositions may be prepared by mixing the toners obtained with the process of the present invention with known or later developed carrier particles. Illustrative examples of carrier particles that may be selected for mixing with the toner composition prepared in accordance with the embodiments include those particles that are capable of triboelectrically obtaining a charge of opposite polarity to that of the toner particles. Accordingly, in embodiments, the carrier particles may be selected so as to be of a negative polarity in order that the toner particles that are positively charged will adhere to and surround the carrier particles. Illustrative examples of such carrier particles include iron, iron alloys steel, nickel, iron ferrites, including ferrites that incorporate strontium, magnesium, manganese, copper, zinc, and the like, magnetites, and the like. Additionally, there may be selected as carrier particles nickel berry carriers as disclosed in U.S. Pat. No. 3,847,604, the entire disclosure of which is totally incorporated herein by reference, comprised of nodular carrier beads of nickel, characterized by surfaces of reoccurring recesses and protrusions thereby providing particles with a relatively large external area. Other carriers are disclosed in U.S. Pat. Nos. 4,937,166 and 4,935,326, the disclosures of which are totally incorporated herein by reference.

The selected carrier particles of embodiments may be used with or without a coating, the coating generally being comprised of acrylic and methacrylic polymers, such as methyl methacrylate, acrylic and methacrylic copolymers with fluoropolymers or with monoalkyl or dialklyamines, fluoropolymers, polyolefins, polystrenes such as polyvinylidene fluoride resins, terpolymers of styrene, methyl methacrylate, and a silane, such as triethoxy silane, tetrafluoroethylenes, other known coatings and the like.

The carrier particles may be mixed with the toner particles in various suitable combinations. The toner concentration is usually about 2 percent to about 10 percent by weight of toner and about 90 percent to about 98 percent by weight of carrier. However, one skilled in the art will recognize that different toner and carrier percentages may be used to achieve a developer composition with desired characteristics.

The toner and developer compositions of embodiments may also include dry-blended fillers, such as, for example, quartz; silicates; aluminosilicates; corundum; ceramic fillers; glass; carbonates, such as chalk, kaolin; inorganic fibers and the like; calcium sulfate; barium sulfate; magnesium sulfate; and any other known or later developed filler materials, and are included in amounts suitable to adjust the rheological characteristics of the toner and developer compositions of embodiments.

Toner compositions of embodiments maybe used in known electrostatographic imaging methods. The resulting toner and developer compositions may be selected for known electrophotographic imaging, digital, printing processes, including color processes, and lithography. Thus for example, the toners or developers of embodiments may be charged, e.g., triboelectrically, and applied to an oppositely charged latent image on an imaging member such as a photoreceptor or ionographic receiver. The resultant toner image may then be transferred, either directly or via an intermediate transport member, to a support such as paper or a transparency sheet. The toner image may then be fused to the support by application of heat and/or pressure, for example with a heated fuser roll.

Specific examples will now be described in detail. These examples are intended to be illustrative, and the invention is not limited to the materials, conditions, or process parameters set forth in these embodiments. All parts and percentages are by weight unless otherwise indicated.

It will be appreciated that various of the above-disclosed and other features and functions, or alternatives thereof may be desirably combined into many other different systems or applications. Also, various presently unforeseen or unanticipated alternatives, modifications, variations or improvements therein may be subsequently made by those skilled in the art, and are also intended to be encompassed by the following claims.

EXAMPLES

Example 1

Preparation of Nanoscale Fluorescent Pigment Particles:

Example 1-A

Synthesis of the fluorescent pigment—Benzo[k,l] thioxanthene-3,4-dicarboxylic Anhydride In a 200 mL 3-neck round bottom flask fitted with magnetic stirrer, reflux condenser and oil bath were introduced 4 g (0.016 mol) 4-nitronaphthalene tetracarboxylic anhydride, 3 mL (0.03 mol) 2-amino-benzenethiol and 40 mL N,N-dimethyl formamide. A dark brown solution resulted. I-Amyl nitrite, 3.2 mL (0.024 mol) was added slowly, via a syringe into the flask. The temperature of the reaction mixture rose to 80° C., and an orange precipitate formed. At the end of the addition, the temperature in the flask was allowed to drop to 60° C. The reaction mixture was then stirred at this temperature for 3 hours to insure completion of the reaction. The solid was filtered through a fritted glass and washed with N,N-dimethyl formamide twice, and once with N,N-dimethyl formamide:distilled water with a weight ratio of 1:1 until the washings were clear. The orange solid was dried in a vacuum oven at 100° C. overnight. Infrared Spectrometry using a KBr pellet resulted in the following data: double anhydride C═O peak at 1758 $cm^{-1}$ and 1721 $cm^{-1}$. The average particle size from Transmission Electron Microscopy was greater than 2 μm in length and many of the particles had a particle width greater than 500 nm.

Example 1-B

Formation of Nanoscale Fluorescent Pigment Particles with SPAN 40.

In a 500 mL resin kettle fitted with mechanical stirring, dropping funnel and ice/water cooling bath were introduced 300 mL N-methyl-2-pyrrolidinone and 2.6 g (0.006 mol) SPAN 40. To this solution was added dropwise over a period of 15 minutes a solution of 30 mL sulfuric acid containing 0.5 g (0.002 mol) benzothioxanthene and 0.050 g (0.0001 mol) perylene tetracarboxylic dianhydride. During the addition, the temperature in the resin kettle rose to 40° C. At the end of the addition, the reaction mixture was allowed to stir at room temperature (about 20° C.) for 30 minutes. The thick mixture was diluted with 500 mL isopropanol:distilled water with a weight ratio of 2:1. The resulted mixture was filtered using a fritted glass. The pigment was washed on the frit twice with 20 mL isopropanol and once with 20 mL isopropanol. Infrared Spectrometry using a KBr pellet resulted in the following data: double anhydride C═O peak at 1758 $cm^{-1}$ and 1721 $cm^{-1}$. The particle size from Transmission Electron Microscopy (wet cake) was 100-500 nm in length and less than 100 nm width.

Example 1C

Formation of Nanoscale Fluorescent Pigment Particles with Oleic Acid.

In a 500 mL resin kettle fitted with mechanical stirring, dropping funnel and ice/water cooling bath were introduced 300 mL N-methyl-2-pyrrolidinone and 4.9 g (0.02 mol) oleic acid. To this solution was added dropwise over a period of 15 minutes a solution of 30 mL sulfuric acid containing 0.5 g (0.002 mol) benzothioxanthene and 0.050 g (0.0001 mol) perylene tetracarboxylic dianhydride. During the addition, the temperature in the resin kettle rose to 40° C. At the end of the addition, the reaction mixture was allowed to stir at room temperature (about 20° C.) for 30 minutes. The thick mixture was diluted with 500 mL isopropanol:distilled water with a weight ratio of 2:1. The resulted mixture was separated using a centrifuge. The pigment particles were washed through centrifugation once with distilled water and once with acetone. Infrared Spectrometry using a KBr pellet resulted in the following data: double anhydride C═O peak at 1758 $cm^{-1}$ and 1721 $cm^{-1}$. The particle size from Transmission Electron Microscopy (wet cake) was 100-500 nm in length and less than 100 nm in width.

The fabricated nanoscale fluorescent pigment particles had a needle like shape with a 100-500 nm in length and less than 100 nm in width. They were green-yellow fluorescent under UV light. The melting temperature of the initial pigment is about 320° C. As a result no leaking or melting of the fluorescent nanoparticles is expected to take place when heated for extended periods of time at 120° C. in the solid ink printer.

Example 2

Fluorescent Organic Nanoparticles Obtained by Modified Emulsion Aggregation Latex Process.

Example 2-A

Preparation of Polyester Latex.

190 g of amorphous propoxylated bisphenol A fumarate resin (Mw-12,500, Tg onset=56.9, acid value 16.7; available commercially as SPAR resins from Reichhold Chemicals, Inc., RESAPOL HT resin from Resana S. A. along with 10 g of DFKY-C7 (Risk Reactor) fluorescent dye were weighed out in a 1 L kettle. 100 g of methyl ethyl ketone and 40 g of isopropanol were weighed out separately and mixed together in a beaker. The solvents were poured into the 1 L kettle containing the resin. The kettle, with its cover on, a gasket, a condenser and 2 rubber stoppers, were placed inside a water bath set at 48° C. for 1 hour. The anchor blade impeller was set up in the kettle and was switched on to rotate at approximately 150 RPM. After 3 hours, when all of the resins dissolved, 8.69 g of 10% $NH_4OH$ was added to the mixture drop-wise with a disposable pipette through a rubber stopper. The mixture was left to stir for 10 minutes. Then 8.0 g of Vazo 52 thermal initiator was added to the mixture and the mixture was stirred for an additional 10 minutes at 48° C. Next, 600 g of deionized water was to be added into the kettle by a pump through a rubber stopper. The first 400 g were added in 90 minutes with the pump set to a rate of 4.44 g/min. The last 200 g were added in 30 minutes with the pump set to 6.7 g/min. The apparatus was dismantled, and the mixture was poured into a glass pan, which was kept in the fume hood overnight and stirred by a magnetic stir-bar so that the solvent could evaporate off. When exposed to black light, the latex emitted red light. The particle size as measured by a Nicomp Particle Analyzer was 170 nm. This latex solution was labeled "Latex A."

Example 2-B

Preparation of Hard Particles by Crosslinking by Radical Initiation.

The above latex solution, Latex A, was charged into a 1 L 3-necked round bottom flask and purged with nitrogen gas for one hour. The mixture was then stirred at 200 RPM and heated to 80° C. and maintained at that temperature for 5 hours. At this temperature, the Vazo 52 initiator produced radicals which initiated a crosslinking reaction between the double bonds of the propoxylated bisphenol A fumarate resin. The latex was then cooled down and freeze-dried to obtain dry particles. When exposed to black light(under UV light), the latex emitted red light. The size of the particles after the crosslinking reaction was 145 nm.

These particles contain the fluorescent dye dispersed into the polyester. The polyester material which constitutes the particles binder is not miscible with solid ink composition and as a result leaching of the dye outside the particles is essentially eliminated. This prevents dye degradation due to interaction with solid ink base components.

Example 3

Fluorescent Organic Nanoparticles Obtained by Emulsion-polymerization.

A surfactant solution consisting of 3.0 g of Neogen RK (anionic emulsifier) and 250 g de-ionized water was prepared by mixing for 10 minutes in a stainless steel holding tank. The holding tank was then purged with nitrogen for 5 minutes before transferring into the reactor. The reactor was then continuously purged with nitrogen while being stirred at 300 RPM. The reactor was then heated up to 76° C. at a controlled rate and held constant. In a separate container, 2.13 g of ammonium persulfate initiator was dissolved in 22 g of de-ionized water. Also in a second separate container, the monomer emulsion was prepared in the following manner. 125 g of methylmethacrylate, 5 g of diethyleneglycol dimethacrylate, 6.4 g of DFKY-C7 Fluorescent Dye (Risk Reactor), 7 g Neogen RK (anionic surfactant), and 135 g of deionized water were mixed to form an emulsion. One percent of the above emulsion was then slowly fed into the reactor containing the aqueous surfactant phase at 76° C. to form the "seeds" while being purged with nitrogen. The initiator solution was then slowly charged into the reactor and after 20 minutes the rest of the emulsion was continuously fed in using metering pump at a rate of 0.6%/minute. Once all the monomer emulsion was charged into the main reactor, the temperature was held at 76° C. for an additional 2 hours to complete the reaction. Full cooling was then applied and the reactor temperature is reduced to 35° C. The product was collected into a holding tank after filtration through a 1 micron filter bag. After drying a portion of the latex the onset Tg was observed to be 105.7° C. The average particle size of the latex as measured by Disc Centrifuge was 73 nm. The particles are red fluorescent under UV light.

Example 4

Toner Preparation

Example 4-A

Preparation of Resin Emulsion A Containing 5% Fluorescent Nanoparticles 155.86 g of amorphous propuxylated bisphnol A fumerate resin (Mw=12,500, Tg onset=56.9, acid value=16.7), 9.21 g of the above fluorescent nanoparticle and 20.9 g of carnauba wax are dissolved in 1101 g of ethyl acetate at 70° C. Separately, 1.9 g of Dowfax 2A-1 solution and 3.0 g of concentrated amomonium hydroxide are dissolved in 850.7 g of deionized water at 70° C. The ethyl acetate solution is then pored slowly into the aqueous solution under continuous high-shear homogenization (10,000 rpm, IKA Ultra-Turrax T50). After an additional 30 min of homogenization, the reaction mixture is distilled at 80° C. for two hours. The resulting emulsion is stirred overnight, strained through a 25-micron sieve, and centrifuged at 3000 rpm for 15 minutes. The supernatant is decanted and yielded 588.2 g of a white, strongly fluorescent latex, with about 170 nm average particle size and 17.86% solids.

Example 4-B

Preparation of Toner Containing Emulsion A

In a 2 L reactor vessel are added 595.27 g of the above Resin Emulsion A having a solids loading of 17.86 weight %, along with 87.48 g of crystalline polyester emulsion (CPE-1) having a solids loading of 17.90 weight %, 63.48 g of cyan pigment PB 15:3 having a solids loading of 17 weight %, 2 g of Dowfax 2A1 surfactant having a solids loading of 47.68 weight %, 123 g of 0.3M HNO3, and 395 g of a deionized water and stirred using an IKA Ultra Turrax®50 homogenizer operating at 4,000 rpm. Thereafter, 36 g of a flocculent mixture containing 3.6 g polyaluminum chloride mixture and 32.4 g of a 0.02 molar (M) nitric acid solution are added dropwise over a period of 5 minutes. As the flocculent mixture is added drop-wise, the homogenizer speed is increased to 5,200 rpm and homogenized for an additional 5 minutes. Thereafter, the mixture is heated at a 1° C. per minute temperature increase to a temperature of 41° C. and held there for a period of about 1.5 to about 2 hours resulting in a volume average particle diameter of 5 microns as measured with a Coulter Counter. During the heat up period, the stirrer is run at about 450 rpm. An additional 282.2 g of the above Resin Emulsion A, 75 g of deionized water, and 10 g of 0.3M HNO3 are added to the reactor mixture and allowed to aggregate for an additional period of about 30 minutes at which time the reactor temperature is increased to 49° C. resulting in a volume average particle diameter of about 5.7 microns. Th pH of the reactor mixture is adjusted to 6 with a 1.0 M sodium hydroxide solution, followed by the addition of 1.048 g of Versene 100. The reactor mixture is then heated at a temperature increase of 1° C. per minute to a temperature of 68° C. The pH of the mixture is then adjusted to 6.0 with a 0.3 M nitric acid solution. The reactor mixture is then gently stirred at 68° C. for about 3 hours to sphereodize the particles. The reactor heater is then turned off and the mixture is allowed to cool to room temperature at a rate of 1° C. per minute. The toner of this mixture has a volume average particle diameter of about 5.7 microns, and a geometric size distribution (GSD) of about 1.24. The particles are washed 5 times, the first wash being conducted at pH 9 at 23° C., followed by 1 wash with deionized water at room temperature, followed by one wash at pH 4.0 at 40° C., and 2 additional washes with deionized water at room temperature.

It will be appreciated that various of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

What is claimed is:

1. A toner composition comprising toner particles formed by an emulsion/aggregation process, wherein the toner particles have a core portion and a shell portion, and comprise:

an unsaturated polymeric resin;

an optional colorant;

an optional wax;

an optional coagulant; and a fluorescent nanoparticle composition comprising a crystalline benzothioxanthene pigment particle; wherein the crystalline benzothioxanthene pigment particle has an average particle length of less than about 150 nm, and average particle width of less than about 30 nm, the crystalline benzothioxanthene pigment particle comprising:

a benzothioxanthene pigment having at least one functional moiety, and at least one sterically bulky stabilizer compound each having at least one functional group, wherein the functional moiety on the benzothioxanthene pigment associates non-covalently with the functional group of the stabilizer.

2. The toner composition according to claim 1, wherein average particle length of the crystalline benzothioxanthene pigment particle is less than about 100 nm and particle aspect ratio (length:width) is less than 5:1 to about 1:1.

3. The toner composition according to claim 1, wherein the average particle width of the crystalline benzothioxanthene pigment particle is less than about 20 nm and particle aspect ratio (length:width) is less than 5:1 to about 1:1.

4. The toner composition according to claim 1, wherein the at least one sterically bulky stabilizer compound includes an ester of sorbitol.

5. The toner composition according to claim 1, wherein the at least one sterically bulky stabilizer compound is selected from the group consisting of a monoester of sorbitol with palmitic acid, a monoester of sorbitol with stearic acid, and a monoester of sorbitol with oleic acid.

6. The toner composition according to claim 1, wherein the at least one sterically bulky stabilizer compound is selected from the group consisting of a triester of sorbitol with palmitic acid, a triester of sorbitol with stearic acid, and a triester of sorbitol with oleic acid.

7. The toner composition according to claim 1, wherein the at least one sterically bulky stabilizer compound includes mono and triesters of sorbitol with palmitic acid.

8. The toner composition according to claim 1, wherein the at least one sterically bulky stabilizer compound includes mono and triesters of sorbitol with stearic acid.

9. The toner composition according to claim 1, wherein the at least one sterically bulky stabilizer compound includes mono and triesters of sorbitol with oleic acid.

10. The toner composition according to claim 1, wherein the at least one sterically bulky stabilizer compound includes an ester of tartaric acid.

11. The toner composition according to claim 1, wherein the at least one sterically bulky stabilizer compound includes a polymer.

12. The toner composition according to claim 11, wherein the polymer is selected from the group consisting of polyvinylpyrrolidone, poly(1-vinylpyrrolidone)-graft-(1-hexadecene), poly(1-vinylpyrrolidone)-graft-(1-triacontene), and poly(1-vinylpyrrolidone-co-acrylic acid).

* * * * *